US006953522B2

(12) United States Patent
Park et al.

(10) Patent No.: US 6,953,522 B2
(45) Date of Patent: Oct. 11, 2005

(54) LIQUID TREATMENT METHOD USING ALTERNATING ELECTRICAL CONTACTS

(75) Inventors: Kyungho Park, Kawasaki (JP); Wataru Okase, Tsukui-gun (JP); Takenobu Matsuo, Tsukui-gun (JP)

(73) Assignee: Tokyo Electron Limited, Tokyo (JP)

( * ) Notice: Subject to any disclaimer, the term of this patent is extended or adjusted under 35 U.S.C. 154(b) by 648 days.

(21) Appl. No.: 09/849,345

(22) Filed: May 7, 2001

(65) Prior Publication Data

US 2001/0037943 A1 Nov. 8, 2001

(30) Foreign Application Priority Data

May 8, 2000 (JP) ..... P2000-135175
May 8, 2000 (JP) ..... P2000-174440

(51) Int. Cl.[7] ..... C25D 5/00; C25F 3/00

(52) U.S. Cl. ..... 205/96; 204/224 R; 204/230.5; 204/DIG. 7; 205/102; 205/118; 205/123; 205/640; 205/687

(58) Field of Search ..... 204/224 R, 230.5, 204/DIG. 7; 205/96, 97, 102, 118, 123, 157, 640, 687

(56) References Cited

U.S. PATENT DOCUMENTS 4,134,801 A * 1/1979 Hofer et al. ..... 428/571
5,167,792 A * 12/1992 Kamitakahara et al. ..... 205/68
6,099,712 A * 8/2000 Ritzdorf et al. ..... 205/123
6,132,587 A * 10/2000 Jorne et al. ..... 205/123
6,500,317 B1 * 12/2002 Yoshioka et al. ..... 204/228.7
6,500,325 B2 * 12/2002 Kosaki et al. ..... 205/96
6,758,958 B1 * 7/2004 Steenkiste et al. ..... 205/118

* cited by examiner

*Primary Examiner*—Roy King
*Assistant Examiner*—William T. Leader
(74) *Attorney, Agent, or Firm*—Pillsbury Winthrop Shaw Pittman LLP

(57) ABSTRACT

A contact is disposed to come into contact with a metal layer formed on a substrate being treated, the contact being in contact with a surface being treated from an opposite surface through a through hole present in a substrate. Alternatively, a contact is disposed to come into contact with a metal layer formed on a substrate, the contact coming into contact at an approximate center of the substrate. Alternatively, a plurality of needle bodies are disposed to be in electrical contact with a metal layer of a substrate being treated, thereby power supply for electrolytic polishing/plating to a substrate being treated being implemented, without restricting to a periphery of a substrate, from a plurality of points on a surface thereof. Due to any one of these, liquid treatment equipment enables to improve uniformity in plane of an electric current sent to a surface being treated and of liquid treatment.

2 Claims, 22 Drawing Sheets

LIQUID TREATMENT METHOD USING ALTERNATING ELECTRICAL CONTACTS

BACKGROUND OF THE INVENTION

1. Field of the Invention

The present invention relates to liquid treatment equipment for liquid treating a surface being treated of a substrate being treated and a liquid treatment method therefor, in particular relates to liquid treatment equipment suitable for improving uniformity in plane of liquid treatment and a liquid treatment method therefor.

2. Description of the Related Art

As a semiconductor device or liquid crystal display device has been required to be processed more and more finely, a liquid treatment process for manufacturing the semiconductor device or liquid crystal display device, in the place of the chemical vapor deposition process, has been frequently employed.

As an example of the liquid treatment process, a process for implementing copper plating on a surface of a wafer that is a substrate being treated is explained. In general, a process for implementing such copper plating is part of a process of forming a copper pattern in a fine trench or bia hole that is formed in advance in each portion of the wafer surface. Here, each portion of the wafer surface is one of regions formed in a large number and is a region to be a single semiconductor device (semiconductor chip).

When copper plating on the wafer surface being treated, prior to the treatment, a seed layer is formed in advance on the wafer surface. The seed layer becomes a cathode in electrolytic plating to supply electricity to a plating layer to be formed and a plating solution, and is a seed in plating.

The seed layer of a thickness of approximately from several nm to approximately 200 nm combines a copper layer of the same material with a layer of different material from a later plating layer. In view of the size relationship with the fine trench or the bia hole formed previously on the wafer surface, the seed layer is formed so as to cover a sidewall surface and a bottom surface of the trench or bia hole. While holding a periphery of the wafer on which such seed layer is formed, an electric conductor (contact) is brought into contact with the seed layer in the neighborhood of the periphery to supply electricity for plating.

The wafer thereto electricity is supplied is immersed in a plating solution bath (treatment solution bath) for the seed layer to be a cathode. In the plating solution bath, for instance an aqueous solution of copper sulfate ($CuSO_4$) that is an electrolytic solution containing plating material is filled. In the plating solution bath, in contact with the aqueous solution of copper sulfate, an anode electrode of copper containing phosphorus is disposed. The plating is implemented by the way that fills the fine trench or bia hole previously formed on the wafer surface and furthermore covers the wafer surface with a definite thickness.

Toward the wafer surface being treated immersed in the plating solution bath, a flow of the plating solution is formed to maintain uniformity in the bath of the plating solution and to bring the plating solution containing an active additive agent always into contact with the wafer surface being treated. For this, at a portion facing the surface being treated in the plating solution bath, an ejection tube of the plating solution is disposed, at an extension that is a root of the ejection tube a pump being disposed to eject the plating solution. The additive agent is added to the plating solution to fill the fine trench or the bia hole with the plating material without leaving void, thereby forming a copper pattern of high quality.

Furthermore, usually, for instance in accordance with an increase of the plating solution in the plating solution bath due to the ejection thereof, a plating solution circulation system is formed. The plating solution circulation system recovers the plating solution overflowed from the plating solution bath and circulates the overflowed plating solution to eject again from ejection tube.

With such configurations, while maintaining uniformity of the plating solution in the bath and always supplying the plating solution containing the active additive agent in the bath, an electricity is supplied between a cathode and an anode. Thereby, copper is reduced to precipitate on the cathode that is initially the seed layer, that is, copper being formed on the seed layer as the plating.

Thus formed plating layer covering the wafer surface with a definite thickness, essentially from an efficiency requirement in the later process, is preferable to be formed with a more uniform thickness on the wafer surface. However, since power for plating is supplied from the periphery of the wafer as mentioned above, the plating layer tends to be formed thicker in the wafer periphery and thinner in a wafer center. This is because, since the seed layer is conductive but very thin, an electric resistance in a radial direction of the wafer cannot be ignored.

That is, when supplying power for plating, during reaching from the wafer periphery to the wafer center, a voltage drop occurs. When seeing a potential distribution of the surface being treated from a potential of an anode electrode, a larger potential difference occurs as goes to the periphery side. Thereby, due to the larger potential difference as goes to the periphery side, a larger electric current flows to result in promotion of the plating.

Accordingly, in the existing plating equipment, if not invoking to any countermeasure, the thickness of a film formed on the wafer surface cannot be uniform but thicker in the periphery, thinner in the center. This point must be improved (nonuniformity in plane of the film thickness).

Next, as another example of a liquid treatment process, an electrolytic polishing process will be explained in which after implementing copper plating on a surface of a wafer that is a substrate being treated, an excess plating layer is polished to remove.

In the semiconductor manufacturing process, usually, subsequent to the plating process, the plating layer is polished. Thereby, only in the fine trench or bia hole formed on the wafer surface, metal can be patterned. That is, as mentioned above, by means of the plating process, the fine trench or bia hole is filled by the metal, and furthermore the metal is plated on the wafer surface with a definite thickness including the fine trench or bia hole. Then, due to the polishing process, while leaving the metal in the fine trench or bia hole, the plating metal other than the above on the wafer surface is polished to remove. For the polishing process, mechanochemical polishing is frequently used but other method than this also can be adopted.

For the equipment for implementing such electrolytic polishing, the plating equipment is frequently diverted. One of reasons is that since the electrolytic polishing process and the plating process are opposite processes as a reaction process, a simple reversal of a polarity applying to the cathode and anode enables to realize.

When diverting the plating equipment as the electrolytic polishing equipment, power supply to the wafer surface for electrolytic polishing is implemented through the periphery thereof. In that case, removal speed of the metal due to the electrolytic polishing is larger as approaches the periphery of the wafer surface.

This is because, as mentioned above, due to the electric resistance of the metal, as approaches the periphery of the wafer surface, only a little larger voltage is generated, thereby between the opposing electrodes, for that a larger electric current is flowed to forward the electrolytic polishing. Accordingly, the metal closer to the periphery of the wafer surface is preferentially polished. When the polishing of that portion proceeds to a bottom surface of the metal layer, a power supply point and the metal surface is electrically disconnected to stop further electrolytically polishing the wafer surface.

As a result, the metal that has not been electrolytically polished and has to be removed remains on the central portion of the wafer surface. The remaining metal to be removed is necessary to be removed by a separate method.

That is, in the existing electrolytic polishing equipment, there is a problem that the metal that has to be polished to remove, without being polished, remains in particular in the neighborhood of the center of the surface being treated (presence of residual metal portion).

SUMMARY OF THE INVENTION

The present invention is carried out in view of the above situations. The object of the present invention is to provide, in liquid treatment equipment for liquid treating a surface being treated of a substrate being treated and a liquid treatment method therefor, liquid treatment equipment capable of improving uniformity in plane of liquid treatment and a liquid treatment method therefor.

To solve the aforementioned problems, liquid treatment equipment involving the present invention comprises a contact, a power supply portion, and an electrode. Here, the contact comes into electrical contact with a metal layer of a substrate being treated that has the metal layer formed thereon and a through hole through the through hole from an opposite surface. The power supply portion is disposed connected through a lead wire to the contact and supplies, from the contact, power of a negative side or positive side to the substrate being treated in electrical contact with the contact. The electrode is disposed connected through the lead wire to the power supply portion and supplies/recovers an electric current flowing, due to the power supply, in an electrolyte in contact with the metal layer through the metal layer.

In the present liquid treatment equipment, the contact is disposed to come into contact with the metal layer formed on the substrate being treated. The contact can come into contact with a surface being treated through the through hole present in the substrate being treated from an opposite surface. Furthermore, by the power supply portion, an electric current is sent from the contact through the suggested route of the substrate surface being treated, the plating solution and the electrode (both directions of the electric current being possible).

Accordingly, the electrical contact between the contact and the substrate being treated is not restricted to the neighborhood of periphery of the substrate being treated. As a result, the uniformity in plane of the electric current sent in the surface being treated can be improved, resulting in an improvement of the uniformity in plane of the liquid treatment.

The liquid treatment includes plating and electrolytic polishing. The substrate being treated includes a semiconductor wafer and a glass substrate for liquid crystal display. These are the same in the following. Furthermore, there can be disposed a plurality of through holes in the substrate being treated for instance in other positions than the neighborhood of the center thereof. Corresponding to this, the liquid treatment equipment can be provided with a plurality of contacts for the through holes each.

Liquid treatment equipment involving the present invention comprises a contact, a power supply portion, and an electrode. Here, the contact comes into electrical contact, in an approximate center of a substrate being treated, with a metal layer of the substrate being treated thereon the metal layer is formed. The power supply portion is disposed connected through a lead wire to the contact and supplies from the contact power of a negative side or positive side to the substrate being treated in electrical contact with the contact. The electrode is disposed connected through a lead wire to the power supply portion and supplies/recovers an electric current flowing, due to the power supply, in an electrolyte in contact with the metal layer through the metal layer.

To the liquid treatment equipment, the contact is disposed to come into contact with the metal layer formed on the substrate being treated, the contact being able to come into contact with an approximate center of the substrate being treated. Furthermore, the power supply portion sends an electric current from the contact, through the suggested route of the substrate surface being treated, the plating solution and the electrode (both directions of the electric current being possible).

Accordingly, the electrical contact between the contact and the substrate being treated is not restricted to the periphery of the substrate being treated. As a result, the uniformity in plane of the current that is sent in the surface being treated can be improved, thereby resulting in an improvement of the uniformity in plane of the liquid treatment.

The liquid treatment includes the plating and electrolytic polishing. The substrate being treated includes a semiconductor wafer and a glass substrate for liquid crystal display. These are as mentioned above.

Furthermore, a liquid treatment method involving the present invention is one in which a voltage is applied between an electrode disposed in contact with a treatment solution accommodated in a liquid treatment bath and a substrate being treated having a metal layer to treat the substrate being treated. The present liquid treatment method comprises a step of coming into electrical contact and a step of supplying power. In the step of coming into electrical contact, a contact member comes into electrical contact with the metal layer of the substrate being treated at an approximate center of the substrate being treated. In the step of supplying power, power of a negative side or positive side is supplied from the contact member to the substrate being treated in electrical contact with the contact member.

Accordingly, in the present method, the electrical contact between the contact and the substrate being treated is not restricted to the periphery of the substrate being treated. As a result, the uniformity in plane of the current that is sent to the surface being treated can be improved, thereby resulting in an improvement of the uniformity in plane of the liquid treatment.

Furthermore, liquid treatment equipment involving the present invention comprises a plurality of needle bodies, a power supply portion, and an electrode. The plurality of needle bodies come into electrical contact with a metal layer of a substrate being treated thereon the metal layer is formed. The power supply portion is disposed connected through a lead wire to the needle body and supplies power from the needle body to the substrate being treated in electrical contact with the needle body. The electrode is disposed connected through a lead wire to the power supply portion and recovers an electric current flowing, due to the power supply, in an electrolyte in contact with the metal layer through the metal layer.

By disposing a plurality of needle bodies in electrical contact with the metal layer of the substrate being treated, the power for electrolytic polishing/plating can be supplied to the substrate being treated, without restricting to the periphery thereof, or to a plurality of points on the surface thereof. Accordingly, the power supply to the substrate surface being treated for electrolytic polishing, even after the polishing has partially reached the base plane of the metal layer, continues in the other regions from other needle bodies. As a result, the metal to be removed does not inhomogeneously remain in particular regions. Furthermore, the power supply to the substrate surface being treated for plating is not restricted to the neighborhood of periphery of the substrate being treated. Accordingly, uniformity in plane of the electric current sent in the surface being treated can be improved. Due to these, uniformity in plane of the liquid treatment can be improved.

Furthermore, a liquid treatment method involving the present invention comprises a step of coming into electrical contact, a step of supplying power, a step of sending electricity, and a step of recovering the electricity. Here, in the step of coming into electrical contact, a plurality of needle bodies come into electrical contact with a metal layer of a substrate being treated thereon the metal layer is formed. In the step of supplying power, the needle bodies supply power to the substrate being treated in electrical contact. In the step of sending electricity, the supplied electricity is sent through the metal layer into an electrolytic solution in contact with the metal layer. In the step of recovering the electricity, the electricity sent into the electrolytic solution is recovered from an electrode disposed in the electrolytic solution.

Also in this method, the similar operation and effects similar with the liquid treatment equipment mentioned immediately above can be obtained.

DESCRIPTION OF THE PREFERRED EMBODIMENTS

Figure 1:
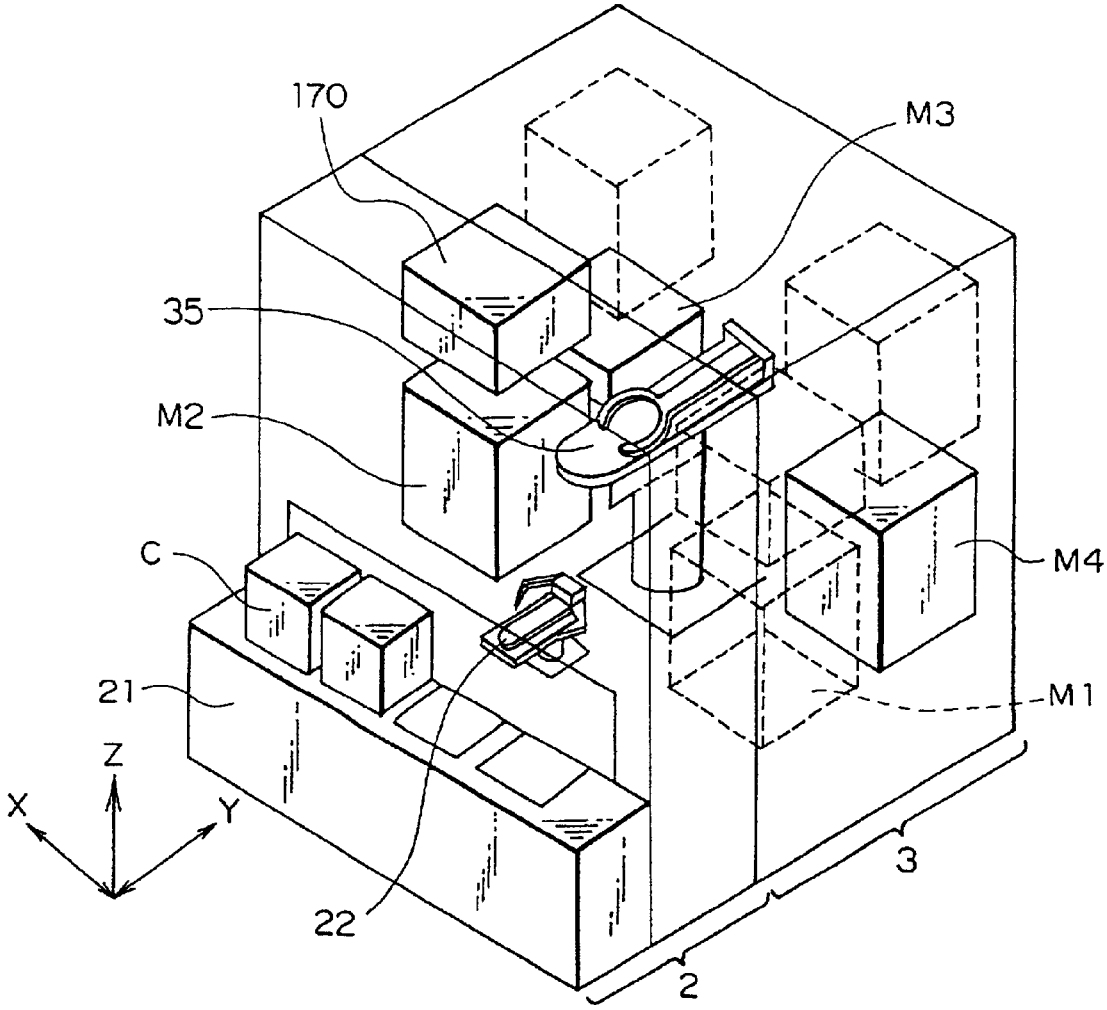
FIG. 1 is a perspective view of a plating system including a plating unit as a liquid treatment unit involving a first embodiment of the present invention.

As a preferred embodiment of the present invention, a liquid treatment equipment includes: a contact coming into electrical contact with a metal layer of a substrate being treated that has the metal layer formed thereon and a through hole, through the through hole from an opposite surface; a power supply portion, disposed connected through a lead wire to the contact, that supplies power of a negative side or positive side from the contact to the substrate being treated in electrical contact with the contact; and an electrode, disposed connected through a lead wire to the power supply portion, that supplies/recovers an electric current that flows, due to the power supply, in an electrolyte in contact with the metal layer through the metal layer. The liquid treatment equipment further comprises a second contact that comes into electrical contact with the metal layer of the substrate being treated at the periphery of the substrate being treated. The second contact is connected to the power supply portion.

The second contact comes into electrical contact with the substrate being treated by means of the existing method, that is, being utilized as primary of power supply to the substrate being treated.

Furthermore, as a preferred embodiment of the present invention, a liquid treatment equipment includes: a contact coming into electrical contact with a metal layer of a substrate being treated that has the metal layer formed thereon and a through hole, through the through hole from an opposite surface; a power supply portion, disposed connected through a lead wire to the contact, that supplies power of a negative side or positive side from the contact to the substrate being treated in electrical contact with the contact; and an electrode, disposed connected through a lead wire to the power supply portion, that supplies/recovers an electric current that flows, due to the power supply, in an electrolyte in contact with the metal layer through the metal layer. The liquid treatment equipment further comprises a second contact, a second power supply portion, and a power supply controller. Here, the second contact comes into electrical contact with the metal layer of the substrate being treated at the periphery thereof. The second power supply portion is disposed connected through a lead wire to the second contact and supplies, from the second contact, power of a negative side or positive side to the substrate being treated in electrical contact with the second contact. The power supply controller is disposed connected to the power supply portion and second power supply portion and controls for the power supplies of the power supply portion and of the second power supply portion to increase and decrease alternatingly.

In the contact connected to the power supply portion and the second contact connected to the second power supply portion, amounts of power supply fed therethrough to the substrate surface being treated are varied during the liquid treatment. A method for varying is such that the amounts of power supply of the power supply portion and the second power supply portion are controlled to increase and decrease alternatingly. Thereby, the uniformity of the treatment of the surface being treated can be more appropriately improved.

Furthermore, as a preferable embodiment of the present invention, a liquid treatment equipment includes: a contact coming into electrical contact with a metal layer of a substrate being treated that has the metal layer formed thereon and a through hole, through the through hole from an opposite surface; a power supply portion, disposed connected through a lead wire to the contact, that supplies power of a negative side or positive side from the contact to the substrate being treated in electrical contact with the contact; and an electrode, disposed connected through a lead wire to the power supply portion, that supplies/recovers an electric current that flows, due to the power supply, in an electrolyte in contact with the metal layer through the metal layer. The liquid treatment equipment further comprises a second contact, a second power supply portion, and a power supply controller. Here, the second contact comes into electrical contact with the metal layer of the substrate being treated at the periphery thereof. The second power supply portion is disposed connected through a lead wire to the second contact and supplies, from the second contact, power of a negative side or positive side to the substrate being treated in electrical contact with the second contact. The power supply controller is disposed connected to the power supply portion and the second power supply portion and controls the power supplies of the power supply portion and of the second power supply portion to be implemented alternatingly.

In the contact connected to the power supply portion and the second contact connected to the second power supply portion, the power supply fed therethrough to the substrate surface being treated is varied during the liquid treatment. A method for varying is such that the power supplies of the power supply portion and the second power supply portion are controlled to be alternatingly implemented. Thereby, the uniformity of the treatment of the surface being treated can be more appropriately improved.

Furthermore, as a preferable embodiment of the present invention, a liquid treatment equipment includes: a contact coming into electrical contact with a metal layer of a substrate being treated that has the metal layer formed thereon and a through hole, through the through hole from an opposite surface; a power supply portion, disposed connected through a lead wire to the contact, that supplies power of a negative side or positive side from the contact to the substrate being treated in electrical contact with the contact; and an electrode, disposed connected through a lead wire to the power supply portion, that supplies/recovers an electric current that flows, due to the power supply, in an electrolyte in contact with the metal layer through the metal layer. The liquid treatment equipment further comprises a second contact, a second power supply portion, and a power supply controller. Here, the second contact comes into electrical contact with the metal layer of the substrate being treated at the periphery thereof. The second power supply portion is disposed connected through a lead wire to the second contact and supplies, from the second contact, power of a negative side or positive side to the substrate being treated in electrical contact with the second contact The power supply controller is disposed connected to the power supply portion and second power supply portion and controls a ratio of the amounts of power supply of the power supply portion and of the second power supply portion to be constant.

In the contact and second contact connected to the power supply portion and the second power supply portion respectively, the power supplies fed therethrough to the substrate surface being treated are controlled during the liquid treatment. A method for control is such that a ratio of the power supply amounts of the power supply portion and the second power supply portion is controlled to be constant. Thereby, the uniformity of the treatment of the surface being treated can be more appropriately improved.

Still furthermore, as a preferable embodiment of the present invention, a liquid treatment equipment includes a contact coming into electrical contact with a metal layer of a substrate being treated thereon the metal layer is formed at an approximate center of the substrate being treated; a power supply portion, disposed connected through a lead wire to the contact that supplies power of a negative side or positive side from the contact to the substrate being treated in electrical contact with the contact; and an electrode, disposed connected through a lead wire to the power supply portion, that supplies/recovers an electric current that flows, due to the power supply, in an electrolyte in contain with the metal layer through the metal layer. The liquid treatment equipment further comprises a second contact coming into electrical contact with the metal layer of the substrate being treated at the periphery thereof, the second contact being connected to the power supply portion.

Furthermore, as a preferable embodiment of the present invention, a liquid treatment equipment includes a contact coming into electrical contact with a metal layer of a substrate being treated thereon the metal layer is formed at an approximate center of the substrate being treated; a power supply portion, disposed connected through a lead wire to the contact, that supplies power of a negative side or positive side from the contact to the substrate being treated in electrical contact with the contact; and an electrode, disposed connected through a lead wire to the power supply portion, that supplies/recovers an electric current that flows, due to the power supply, in an electrolyte in contact with the metal layer through the metal layer. The liquid treatment equipment further comprises a second contact, a second power supply portion, and a power supply controller. Here, the second contact comes into electrical contact with the metal layer of the substrate being treated at the periphery thereof. The second power supply portion is disposed connected through a lead wire to the second contact and supplies, from the second contact, power of a negative side or positive side to the substrate being treated in electrical contact with the second contact. The power supply controller is disposed connected to the power supply portion and second power supply portion and controls the power supplies of the power supply portion and the second power supply portion to increase and decrease alternatingly.

Furthermore, as a preferable embodiment of the present invention, a liquid treatment equipment includes a contact coming into electrical contact with a metal layer of a substrate being treated thereon the metal layer is formed at an approximate center of the substrate being treated; a power supply portion, disposed connected through a lead wire to the contact, that supplies power of a negative side or positive side from the contact to the substrate being treated in electrical contact with the contact; and an electrode, disposed connected through a lead wire to the power supply portion, that supplies/recovers an electric current that flows, due to the power supply, in an electrolyte in contact with the metal layer through the metal layer. The liquid treatment equipment further comprises a second contact, a second power supply portion, and a power supply controller. Here, the second contact comes into electrical contact with the metal layer of the substrate being treated at the periphery thereof. The second power supply portion is disposed connected through a lead wire to the second contact and supplies, from the second contact, power of a negative side or positive side to the substrate being treated in electrical contact with the second contact, The power supply controller is disposed connected to the power supply portion and the second power supply portion and controls the power supplies of the power supply portion and the second power supply portion to be implemented alternatingly.

Furthermore, as a preferable embodiment of the present invention, a liquid treatment equipment includes a contact coming into electrical contact with a metal layer of a substrate being treated thereon the metal layer is formed at an approximate center of the substrate being treated; a power supply portion disposed connected through a lead wire to the contact, that supplies power of a negative side or positive side from the contact to the substrate being treated in electrical contact with the contact; and an electrode, disposed connected through a lead wire to the power supply portion, that supplies/recovers an electric current that flows, due to the power supply, in an electrolyte in contact with the metal layer through the metal layer. The liquid treatment equipment further comprises a second contact, a second power supply portion, and a power supply controller. Here, the second contact comes into electrical contact with the metal layer of the substrate being treated at the periphery thereof. The second power supply portion is disposed connected through a lead wire to the second contact and supplies, from the second contact, power of a negative side or positive side to the substrate being treated in electrical contact with the second contact. The power supply controller is disposed connected to the power supply portion and second power supply portion and controls a ratio of the amounts of power supply of the power supply portion and the second power supply portion to be constant.

Furthermore, as a preferable embodiment of the present invention, a liquid treatment method in which by applying a voltage between an electrode disposed in contact with a treatment solution accommodated in a liquid treatment bath and a substrate being treated having a metal layer, the substrate being treated is liquid treated, the method comprising coming into electrical contact, due to a first contact member, with the metal layer of the substrate being treated at an approximate center of the substrate being treated, and supplying power of a negative side or positive side from the first contact member to the substrate being treated in electrical contact with the first contact member. The method further comprises a step of coming line electrical contact and a step of supplying power. In the step of coming into electrical contact, a second contact member comes into electrical contact with the metal layer of the substrate being treated at the periphery of the substrate being treated. In the step of supplying power, to the substrate being treated in electrical contact with the second contact member, from the second contact member, power of a negative side or positive side is supplied. Here, the amounts of power supply from the contact and the second contact are controlled to increase and decrease alternatingly.

Still furthermore, as a preferable embodiment of the present invention, a liquid treatment method in which by applying a voltage between an electrode disposed in contact with a treatment solution accommodated in a liquid treatment bath and a substrate being treated having a metal layer, the substrate being treated is liquid treated, the method comprising coming into electrical contact, due to a first contact member, with the metal layer of the substrate being treated at an approximate center of the substrate being treated, and supplying power of a negative side or positive side from the first contact member to the substrate being treated in electrical contact with the first contact member. The liquid treatment method further comprises a step of coming into electrical contact and a step of supplying power. In the step of coming into electrical contact, a second contact member comes into electrical contact with the metal layer of the substrate being treated at the periphery of the substrate being treated. In the step of supplying power, to the substrate being treated in electrical contact with the second contact member, therefrom power of a negative side or positive side is supplied. Here, the power supplies from the contact and second contact are controlled to be implemented alternatingly.

Furthermore, as a preferable embodiment of the present invention, a liquid treatment method in which by applying a voltage between an electrode disposed in contact with a treatment method solution accommodated in a liquid treatment bath and a substrate being treated having a metal layer, the substrate being treated is liquid treated, the method comprising coming into electrical contact, due to a first contact member, with the metal layer of the substrate being treated at an approximate center of the substrate being treated, and supplying power of a negative side or positive side from the first contact member to the substrate being treated in electrical contact with the first contact member. The liquid treatment method further comprises a step of coming into electrical contact and a step of supplying power. In the step of coming into electrical contact, a second contact member comes into electrical contact with the metal layer of the substrate being treated at the periphery of the substrate being treated. In the step of supplying power, to the substrate being treated in electrical contact with the second contact member, therefrom power of a negative side or positive side is supplied. Here, a ratio of the amounts of power from the contact and the second contact is controlled to be constant.

Furthermore, as a preferable embodiment of the present invention, a liquid treatment equipment comprising; a plurality of needle bodies coming into electrical contact with a metal layer of a substrate being treated thereon the metal layer is formed; a power supply portion, disposed connected through a lead wire to the needle body, that supplies electricity from the needle body to the substrate being treated in electrical contact with the needle body; and an electrode, disposed connected through a lead wire to the power supply portion, that recovers an electric current flowing, due to the power supply, in an electrolyte in contact with the metal layer through the metal layer. The liquid treatment equipment further comprises a pressure detector and a movable portion. Here, the pressure detector is disposed to the needle body and detects a pressure when the needle body comes into contact with the metal layer. The movable portion is disposed to the needle body and moves the needle body in a direction approximately vertical to the substrate surface being treated to control the detected pressure to be constant.

By controlling the pressure when the plurality of needle bodies come into contact with the metal layer to be constant, the needle bodies are prevented from scratching the substrate surface being treated. Thereby, without causing a scratch on the substrate surface being treated, the liquid treatment of high quality can be realized.

The contact pressure of the needle body against the substrate being treated can be detected for instance by converting a slight movement of a root of the needle body caused by the contact of the needle body with the substrate surface into an electric signal by means of a piezoelectric element. In addition, to enable to move the needle body in a direction approximately vertical with respect to the substrate surface being treated to maintain the detected pressure constant, for instance the following method can be taken. That is, a piezoelectric element is disposed at the root of the needle body, and an electric signal is applied thereto to convert into a mechanical signal. At that time, while looking at the results of detection of the contact pressure mentioned above, electric signal is applied.

The needle bodies as mentioned above and the piezoelectric element disposed at the root thereof, by means of microelectronics and micro-machining technology, can be minutely built in the substrate that is a table of the needle bodies.

Still furthermore, as a preferable embodiment of the present invention, a liquid treatment method includes: coming into electrical contact due to a plurality of needle bodies, with a metal layer of a substrate being treated thereon the metal layer is formed; supplying electricity from the needle body to the substrate being treated in electrical contact; sending supplied electricity through the metal layer in an electrolyte in contact with the metal layer; and recovering, from an electrode disposed in the electrolyte, the electricity sent in the electrolyte. In the liquid treatment method, the step where a plurality of needle bodies come into electrical contact with a metal layer of a substrate being treated thereon the metal layer is formed is facilitated by implementing in the following way. That is, the pressure when the needle body comes into contact with the metal layer is detected and the needle body is facilitated to move in a direction approximately vertical to the substrate surface being treated to maintain the detected pressure constant.

The present method can be realized due to the configuration of the aforementioned treatment equipment. Accordingly, the operation and effects thereof are the same with those explained in the aforementioned equipment.

In the following, embodiments of the present invention will be explained with reference to the drawings.

(First Embodiment)

Figure 2:
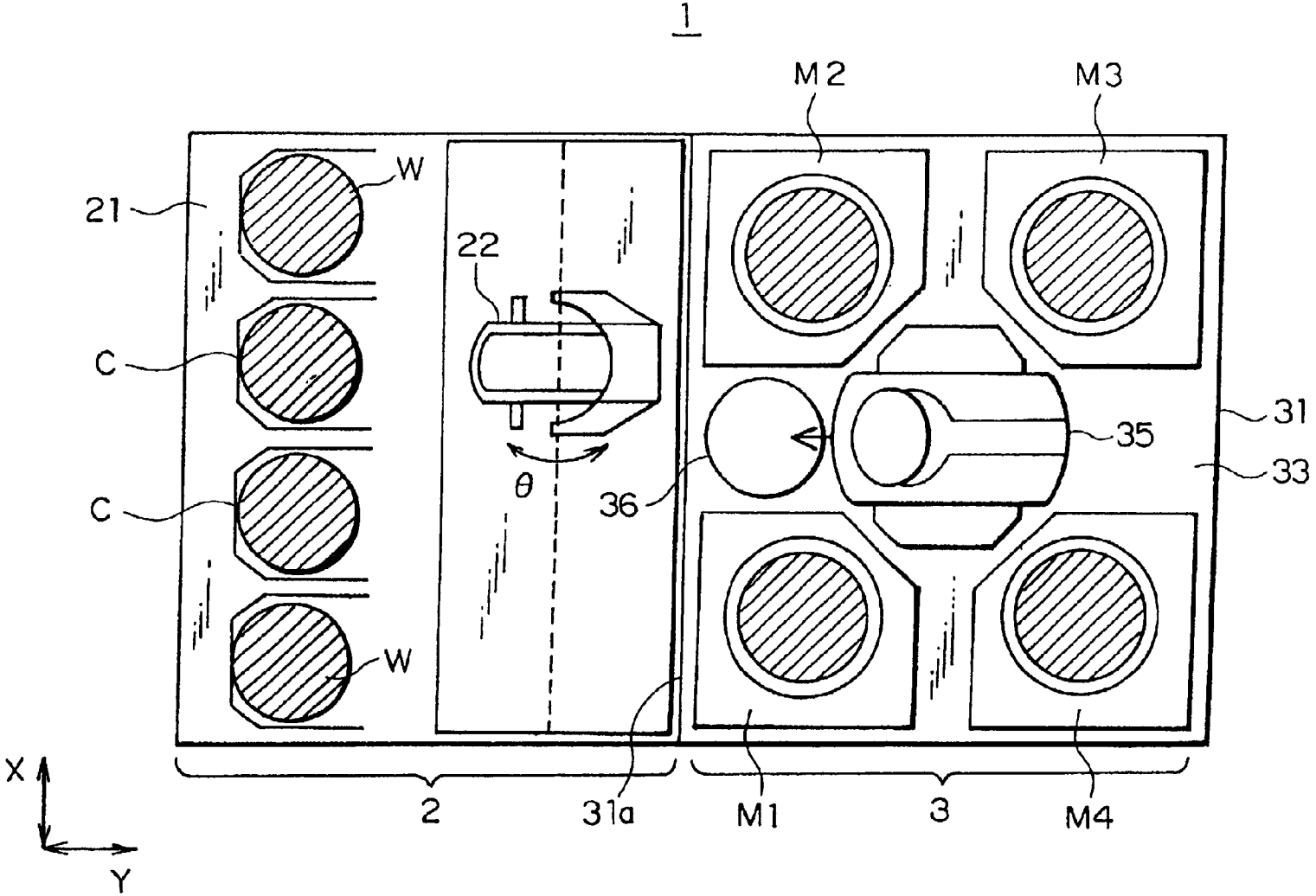
FIG. 2 is a plan view of the plating system.
Figure 3:
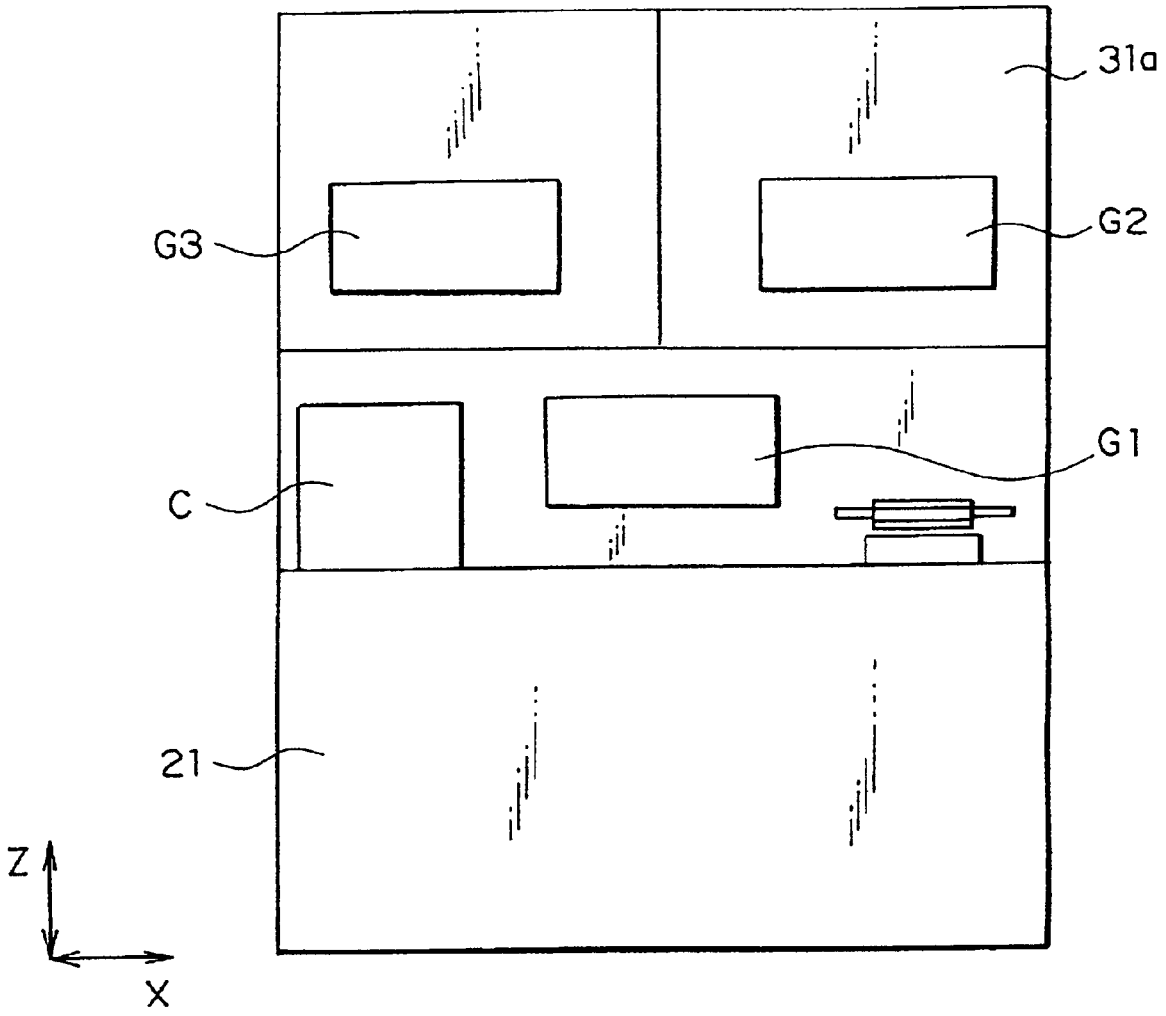
FIG. 3 is a front view of the plating system.
Figure 4:
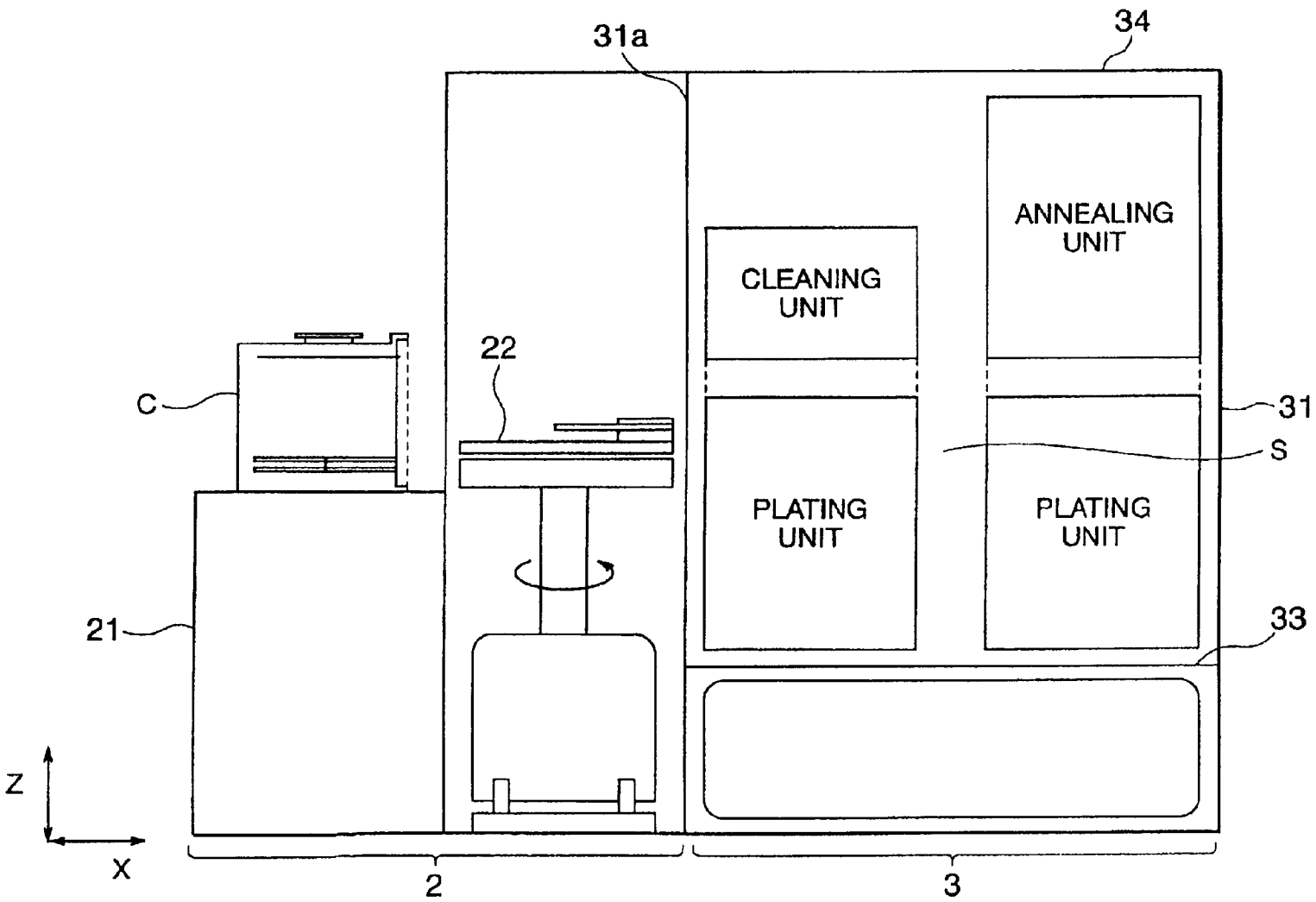
FIG. 4 is a side view of the plating system.

FIG. 1 is a perspective view of a plating system including plating equipment as liquid treatment equipment involving a first embodiment of the present invention, FIG. 2 a plan view of the same plating system, FIG. 3 a front view of the same plating system, FIG. 4 a side view of the same plating system.

As shown in FIGS. 1 through 4, the plating system 1 is constituted of a carrier station 2 for transferring in and out and transferring a wafer W, and a process station 3 for implementing actual treatment on the wafer W.

The carrier station 2 is constituted of a susceptor 21 for accommodating a wafer W and a sub-arm 22 as a second transfer means that makes access to a carrier cassette C disposed on the susceptor 21 to take out the wafer W accommodated therein and accommodates the wafer W after the treatment.

In the carrier cassette C, a plurality, for instance, 25 sheets, of wafers W can be accommodated level equidistance apart in a vertical direction. On the susceptor 21, in an X direction in the drawing, for instance four sets of carrier cassettes C are disposed.

The sub-arm 22 is provided with a structure capable of, in addition to moving on a rail disposed in a X direction in the drawing, elevating in a vertical direction (Z direction), that is, a direction right to the paper plane of FIG. 2, and spinning in a level plane. The sub-arm 22 makes access to the interior of the carrier cassette C disposed on the susceptor 21 to take out an untreated wafer W of and accommodate a wafer W after treatment in the carrier cassette C. Furthermore, the sub-arm 22 delivers the wafer W before and after the treatment between the process station 3.

The process station 3 has an appearance of a cubic or parallelepiped box as shown in FIGS. 1 through 4, an entire surroundings thereof being covered by a housing 31 made of corrosion resistant material such as for instance resin or a metal plate whose surface is coated by resin.

An interior of the process station 3, as shown in FIGS. 1 and 4, is structured into an approximate cubic or parallelepiped box, inside thereof a treatment space S being formed. The treatment space S, as shown in FIGS. 1 and 4, is a parallelepiped treatment chamber, at a base of the treatment space S a base plate 33 being attached.

In the treatment space S, a plurality, for instance four sets, of plating units M1 through M4 are disposed for instance in the surroundings of a main-arm 35 described below in the treatment space S.

As shown in FIGS. 1 and 2, in an approximate center of the base plate 33, there is disposed a main-arm 35 as a first transfer means to transfer the wafer W. The main-arm 35 is capable of elevating and spinning in a level plane, and further provided with two upper and lower wafer hold members extensible in an approximate level plane. The main-arm 35, by extending these wafer hold members, can deliver the wafer before and after the treatment between one of treatment units disposed in the surroundings of the main-arm 35. Furthermore, the main-arm 35 can move in a vertical direction to go in and out of an upper side treatment unit. Accordingly, the main-arm 35 can transfer the wafer W from a treatment unit on a lower tier side to that on an upper tier side, or on the contrary from the treatment unit on the upper tier side to that on the lower tier side.

Furthermore, the main-arm 35, being provided with a function of turning upside down a held wafer W, can turn upside down the wafer W during the transfer of the wafer W from one treatment unit to another treatment unit. The function of turning upside down the wafer W is not an indispensable function of the main-arm 35.

On the upper tier side, on a closer side to the carrier station, that is, above the plating units M1 and M2, for instance two sets of for instance cleaning units SRD are disposed, respectively. Since a plurality of treatment units are disposed thus in multi-tiers in an up and down direction, the utility and efficiency of an area of the liquid treatment system can be improved.

Of the housing 31 of the process station 3, a housing 31*a* disposed at a position facing to the carrier station 2 is provided with, as shown in FIG. 3, three openings G1 through G3 that can be opened. Among these, the opening G1 is an opening corresponding to a position of a middle susceptor 36 disposed between the plating units M1 and M2 disposed on the lower tier side. The opening G1 is used when an untreated wafer W taken out of the carrier cassette C by the sub-arm 22 is sent in the process station 3. When sending in the wafer W, the opening G1 is opened, the sub-arm 22 extending the wafer hold member holding the untreated wafer W into the treatment space S to dispose the wafer W on the middle susceptor 36. The main-arm 35 makes access to the middle susceptor 36, holds the wafer W disposed on the middle susceptor 36 and transfers into the treatment unit such as the plating units M1 through M4.

The remaining openings G2 and G3 are disposed at positions corresponding to the SRD disposed on a side closer to the carrier station 2 in the treatment space S. The sub-arm 22 makes access through one of these openings G2 and G3 to the interior of the treatment space S to make direct access to the SRD disposed on the upper tier side, thereby receiving a treated wafer W. Accordingly, the wafer W cleansed in the SRD is prevented from touching with the stained main-arm to be contaminated.

Furthermore, in the treatment space S, an airflow is formed directing from above to below in FIG. 4. Clean air supplied from outside of the system is fed from an upper portion of the treatment space S, flowing down through the cleaning unit and the plating units M1 through M4 to be exhausted outside the system from the base portion of the treatment space S.

By flowing thus the clean air from above to below in the treatment space S, the air is prevented from flowing from the plating units M1 through M4 on the lower tier side to the cleaning unit on the upper tier side. Accordingly, the cleaning unit side can be always maintained in a clean atmosphere.

Furthermore, the interiors of the respective treatment units such as the plating units M1 through M4 and cleaning unit are maintained lower in pressure than in the treatment space S. Accordingly, the air flows from the treatment space S side to the interiors of the respective treatment units, therefrom being exhausted outside the system. Therefore, contamination can be prevented from diffusing from the treatment unit side to the treatment space S side.

Figure 5:
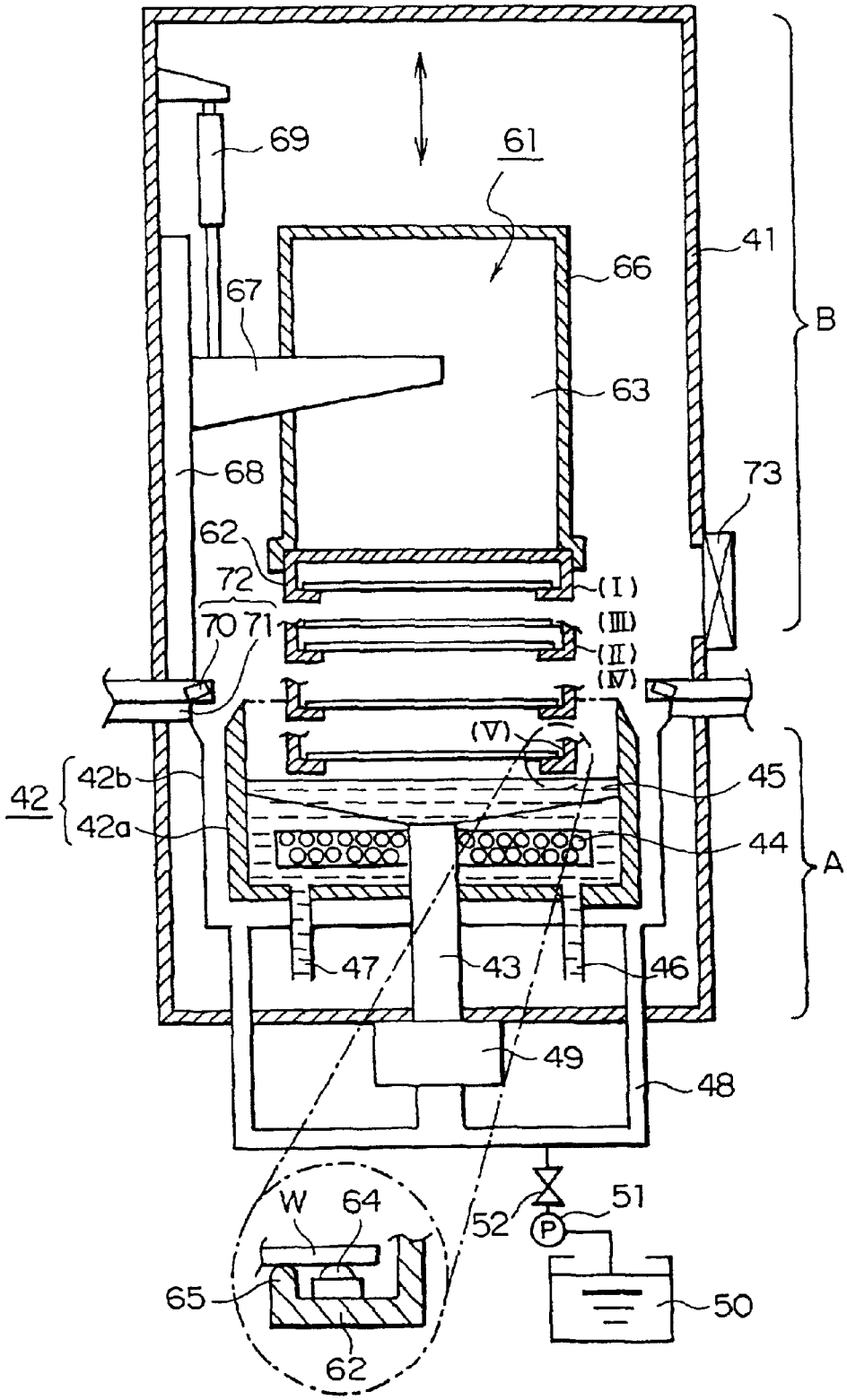
FIG. 5 is a diagram showing the plating unit M1 (or M2, or M3) shown in FIGS. 1 through 4 in vertical sectional view.

FIG. 5 is a vertical sectional view of the plating unit M1 (or M2, M3, M4, the same in the following) shown in FIGS. 1 through 4. As shown in FIG. 5, in the plating unit M1, an entire unit is covered by an airtightly structured housing 41. The housing 41 is also made of corrosion resistant material such as resin or the like.

The interior of the housing 41 is generally partitioned, by a separator 72 having a built-in exhaust path, in two tiers of a first treatment portion A above the separator 72 and a second treatment portion B thereunder 72. Accordingly, the separator 72 prevents the contamination from diffusing from the second treatment portion B side to the upper first treatment portion A side.

In the center of the separator 72, there is disposed a passage opening. Through the passage opening, the wafer W held by a driver 61 described below comes and goes between the first and second treatment portions A and B.

To the housing at a boundary between the treatment portions A and B, an opening and a gate valve 73 to open the opening are disposed. By shutting the gate valve 73, the interior of the plating unit M1 is shielded from the treatment space S outside thereof, thereby the contamination being prevented from diffusing from the plating unit M1 to the exterior treatment space S.

Furthermore, the plating units M1 through M4 each are configured to be operated independently from each other and to be separately detached from the treatment system. Accordingly, when one of the plating units M1 through M4 is stopped operating due to maintenance or the like, another plating unit can substitute to take on. As a result, maintenance can be implemented with ease for each unit.

To the first treatment portion A, a driver 61 as a substrate hold mechanism is disposed, which holds the wafer W approximately level to spin. The driver 61 is configured of a holder 62 for holding the wafer W and a motor 63 for spinning the wafer W together with the holder 62 in an approximately level plane. To a cover of the motor 63, a support beam 67 is attached to support the driver 61. One end of the support beam 67 is attached through a guide rail 68 to an inner wall of the housing 41 to be elevated. The support beam 67 is further attached through a cylinder 69 to the housing 41. By driving the cylinder 69, the driver 61 can be moved up and down.

Specifically, as shown in FIG. 5, the driver 61 moves the wafer W up and down between essentially following four positions (I), (II), (IV) and (V). The four positions are a transfer position (I) for transferring in and out the wafer W, a cleaning position (II) for cleaning a surface being treated on a lower surface side of the wafer W, a spin dry position (IV) for implementing the spin dry described below, and a plating position (V) for plating the wafer W immersed in the plating solution.

Inside the driver 61, an elevation mechanism (omitted from showing) is disposed to elevate the wafer W alone. By actuating the elevation mechanism, without changing a height of the driver 61 itself, only a height of the wafer W can be changed inside the driver 61. The elevation mechanism is actuated when a cathode contact 64 which applies a voltage when coming into contact with a lower surface periphery of the wafer W and the wafer W come into or leave from contact. For instance, when cleaning the cathode contact 64, the elevation mechanism raises the wafer W to expose a contact surface, thereby the cleaning due to water ejected from a nozzle 70 being implemented with ease. A position of the wafer W when the cathode contact 64 is cleansed is the position (III).

To the second treatment portion B, a plating solution bath 42 is disposed to accommodate a plating solution for copper plating such as for instance copper sulfate. The plating solution bath 42 is structured in a double bath, outside an inner bath 42*a* an outer bath 42*b* being disposed approximately concentrically. The plating solution bath 42 is disposed immediately below the aforementioned driver 61. A height of the inner bath 42*a* is fixed so that a liquid level of the plating solution when the inner bath 42*a* is filled by the plating solution is higher than a height of the wafer W held by the driver 61 staying at the plating position (V).

An ejection tube 43 extends from an approximate center of a base in the inner bath 42*a* to an approximate midway in a depth direction of the inner bath 42*a* to eject upwardly the plating solution from the base side. In the surroundings of the ejection tube 43, an electrode 44 is disposed that functions as an anode when implementing electrolytic plating. Between an end periphery of the ejection tube 43 and the inner bath 42*a*, a membrane 45 is disposed to prevent impurities mingling from the electrode 44 during electrolytic plating from floating above the liquid level of the plating solution to disturb the plating. At positions out of center of the base of the inner bath 42*a*, there are disposed circulation piping 46 and 47 to circulate the plating solution. The plating solution is circulated by means of a pump not shown in the drawing. The plating solution inhaled by the circulation piping 47 is supplied from the circulation piping 46.

Between the outer bath 42 *b* and an exterior surface of the inner bath 42 *a*, there is formed a passage in which the plating solution flows. Furthermore, to the base of the outer bath 42 *b*, piping 48 is connected to return the plating solution flowed in the passage into the inner bath 42 *a*. The piping 48 is connected through the pump 49 to the ejection tube 43. By actuating the pump 49, the plating solution overflowed from the inner bath 42 *a* into the passage and piping 48 is returned again into the inner bath 42 *a* and ejected toward the surface being treated on the lower surface side of the wafer W.

Figure 6:
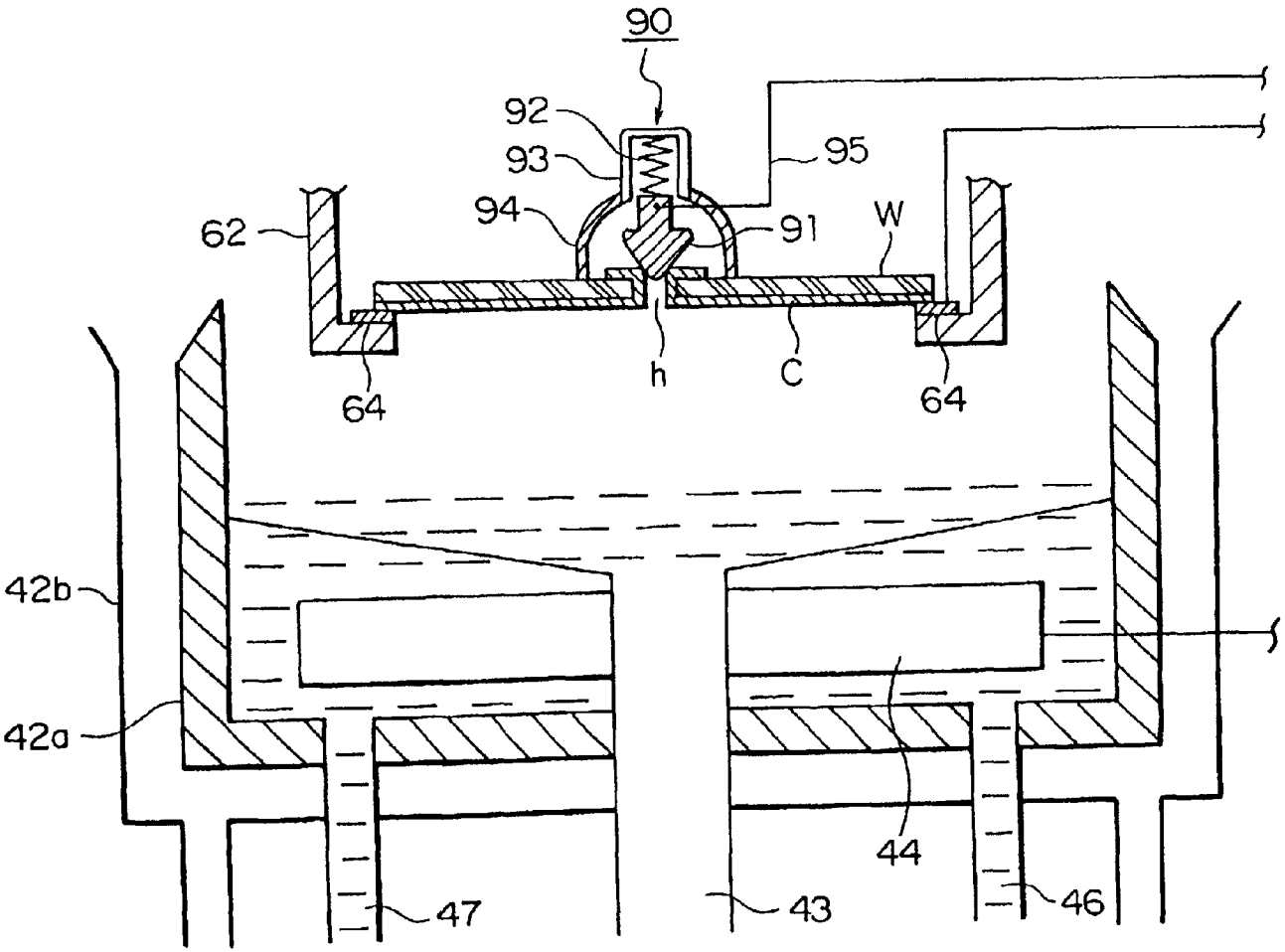
FIG. 6 is a vertical sectional view showing a partial enlargement of the surroundings of a holder 62 of the plating unit M1 shown in FIG. 5.

Next, the wafer W hold portion at the lower end of the holder 62 of the plating unit M1 will be explained. FIG. 6 is a vertical sectional view partially enlarged the surroundings of the holder 62 of the plating unit M1 shown in FIG. 5.

As shown in FIG. 6, in the plating unit involving the present invention, a wafer W in the center of which a through hole h is bored is used as a substrate being treated. Through the through hole h, from a back surface of the wafer W, that is, from the upper surface side in the drawing thereon no plating layer is formed, by means of a center cathode contact mechanism 90 as a voltage application means, a voltage is applied.

The center cathode contact mechanism 90 comprises a center cathode contact 91, a coil spring 92, a housing 93, and a bowl like sealant 94. Here, the center cathode contact 91 comes into direct contact, from a back surface side of a wafer W, with for instance a through hole h of the wafer W in which a seed layer C is formed up to the back surface side. The coil spring 92 backs up the center cathode contact 91. The housing 93 is formed in a cylinder with a bottom to support a lower portion of the coil spring 92. The bowl like sealant 94 made of flexible insulating material such as for instance silicone rubber is attached to an opening side of the housing 93 and seals the surroundings of a point of contact between the center cathode contact 91 and the wafer W. To the center cathode contact 91, there is disposed a lead wire 95 to supply electricity.

The lead wire 95 is connected, as described below, to a power supply to be applied the same voltage with a potential of a cathode contact 64. In an internal space of the sealant 94, air or an inert gas is supplied to give a positive pressure therein, thereby enabling to prevent the plating solution from adhering the point of contact between the center cathode contact 91 and the wafer W.

Figure 7A:
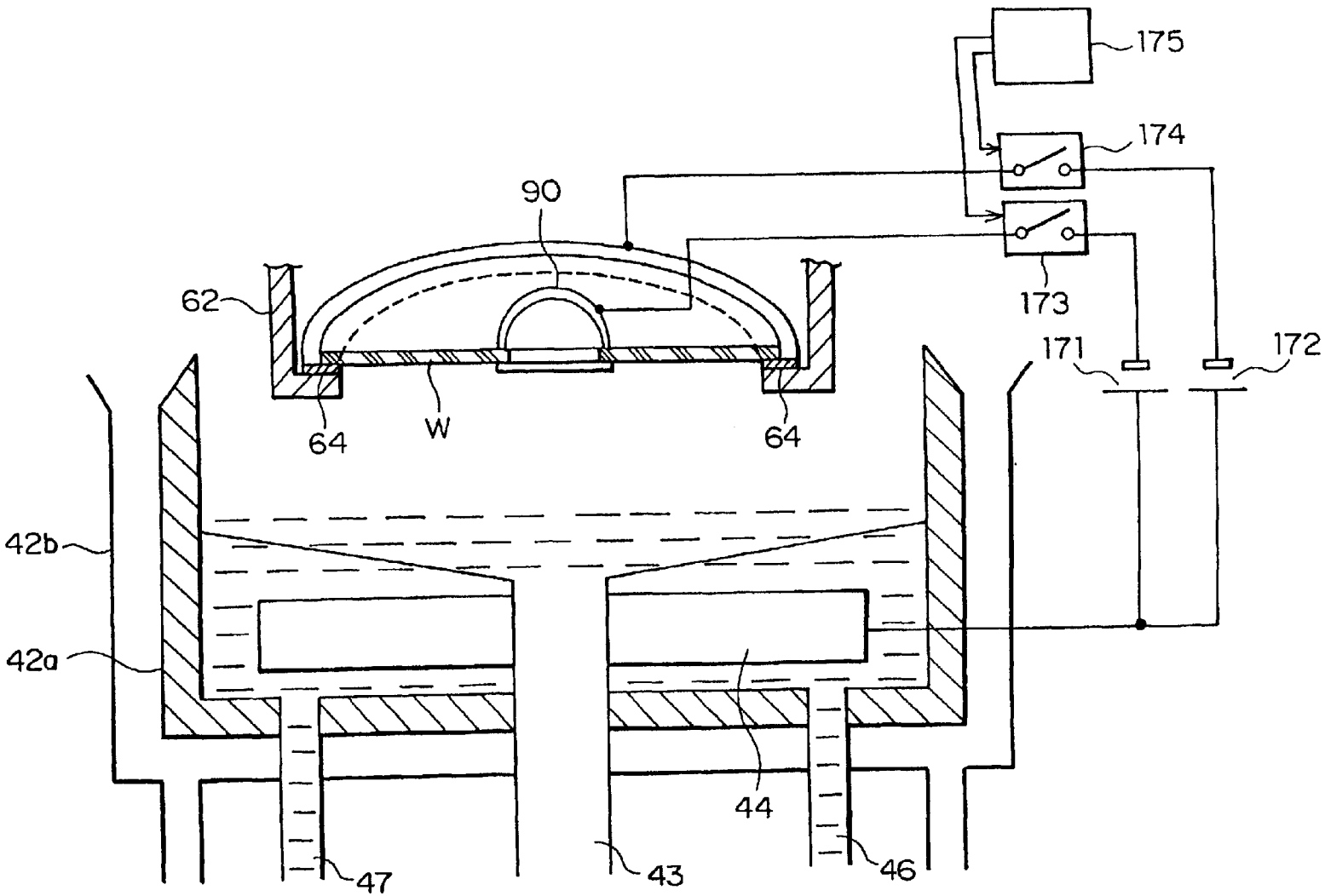
FIG. 7A is a diagram showing a wafer W hold portion at a lower end of the holder 62 shown in FIG. 6 and an electric system for applying a cathode voltage.

FIG. 7A is a diagram showing a wafer hold portion at a lower end of the holder 62 shown in FIG. 6 and an electric system for applying a cathode voltage.

As shown in FIG. 7A, in the present plating unit, the same voltage with that applied to cathode contacts 64, 64, . . . due to a DC power source 172 is applied to the center cathode contact mechanism 90 due to a DC power source 171. Furthermore, by switching switches 173 and 174, between the cathode contacts 64, 64, . . . and the center cathode contact mechanism 90, the voltage can be applied alternatingly, simultaneously, or singly. Furthermore, the switching due to the switches 173 and 174 can be controlled to any desired extent by means of a controller 175.

Figure 7B:
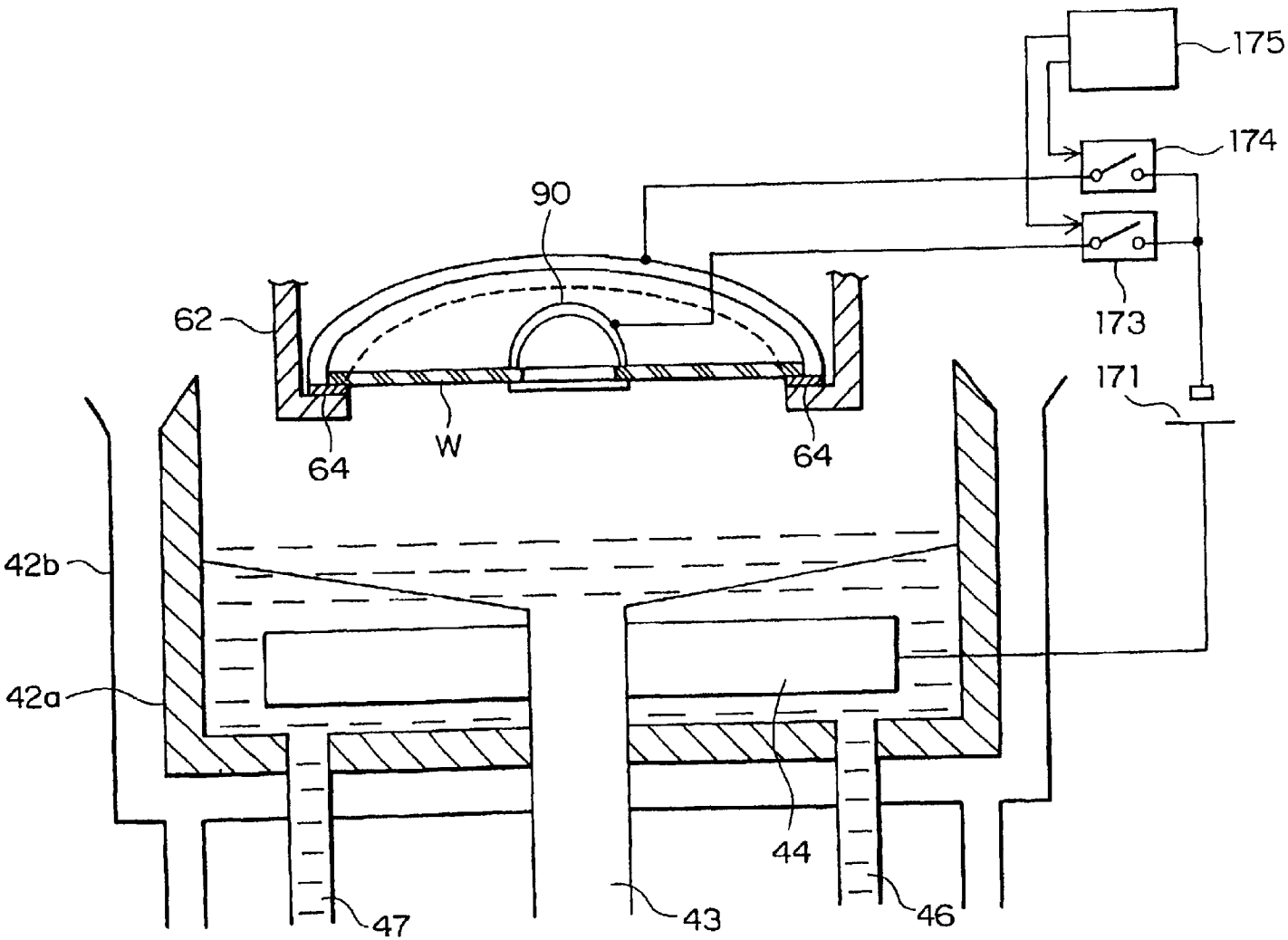
FIG. 7B is a diagram showing a wafer W holder at a lower end of the holder 62 shown in FIG. 6 and an electric system for applying a cathode voltage, being different from one shown in FIG. 7A.

As shown in FIG. 7B, the DC power sources 171 and 172 shown in FIG. 7A can be unified into the same DC power source 171. FIG. 7B shows a wafer W hold portion at a lower end of the holder 62 shown in FIG. 6 and an electric system for applying a cathode voltage, being different from one shown in FIG. 7A.

Figure 7C:
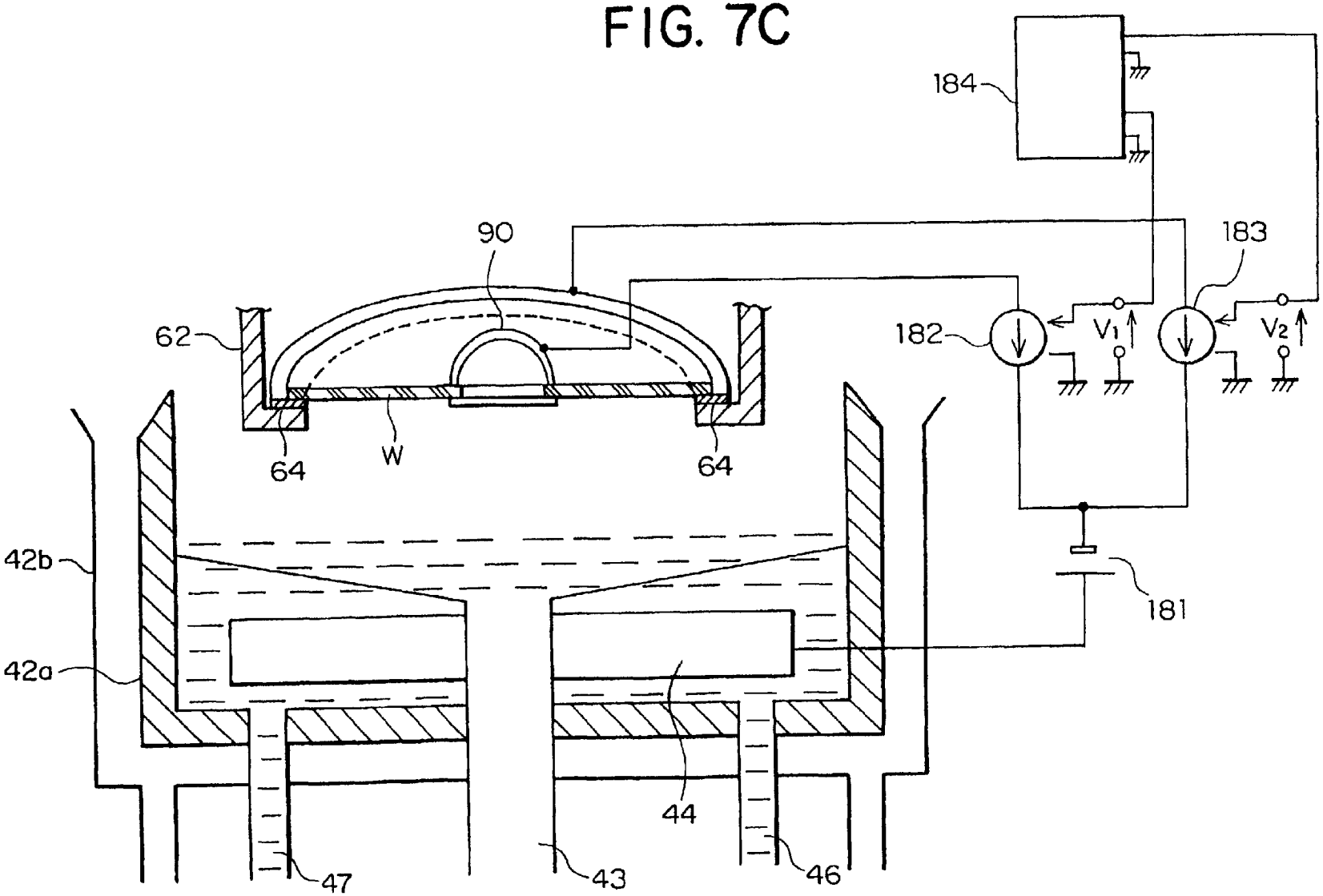
FIG. 7C is a diagram showing a wafer W holder at a lower end of the holder 62 shown in FIG. 6 and an electric system for applying a cathode voltage, being different from ones shown in FIGS. 7A and 7B.

Furthermore, as shown in FIG. 7C, when the switches 173 and 174 shown in FIG. 7B are substituted by control current sources 182 and 183 respectively, electric currents for plating can be gradually varied, or a ratio therebetween can be maintained at a definite value. FIG. 7C shows a wafer W hold portion at the lower end of the holder 62 shown in FIG. 6 and an electric system for applying a cathode voltage, being different from ones shown in FIG. 7A and 7B.

In FIG. 7C, a DC power source 181 is a power source whose voltage is determined in view of a voltage generated between both ends of the control current source 182 (or 183). The control current source 182 is controlled in current due to a control input voltage V1, the control current source 183 being controlled in current due to a control input voltage V2. The control input voltages V1 and V2 are desirably supplied by means of a controller 184.

Figure 8A:
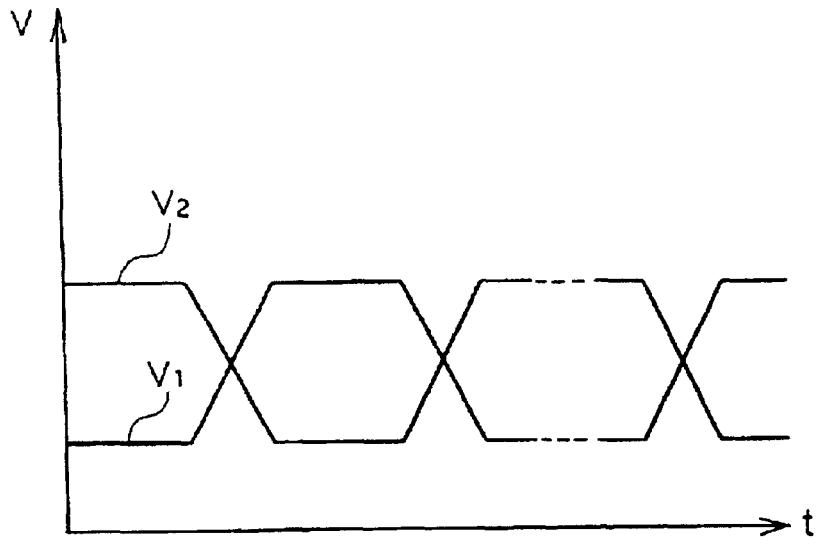
FIG. 8A is a time diagram showing an example of control input voltages V1 and V2 generated by a controller 184 shown in FIG. 7C.

An example of the control input voltages V1 and V2 that the controller 184 generates will be explained with reference to FIG. 8A. FIG. 8A is a time diagram showing examples of control input voltages V1 and V2 that the controller 184 shown in FIG. 7C generates.

As shown in FIG. 8A, in the case of this example, the control input voltages V1 and V2 are generated to change alternatingly their intensities. By implementing thus, the electric currents of the control current sources 182 and 183 shown in FIG. 7C also alternate temporally their intensities in proportion to the above. Accordingly, the plating layer formed on the wafer W can be alleviated in tendency of becoming thicker toward only the neighborhood of the periphery thereof. As a result, uniformity in plane of the current sending in the surface being treated of the wafer W can be improved, resultantly uniformity in plane of the liquid treatment (now, plating) being improved.

Figure 8B:
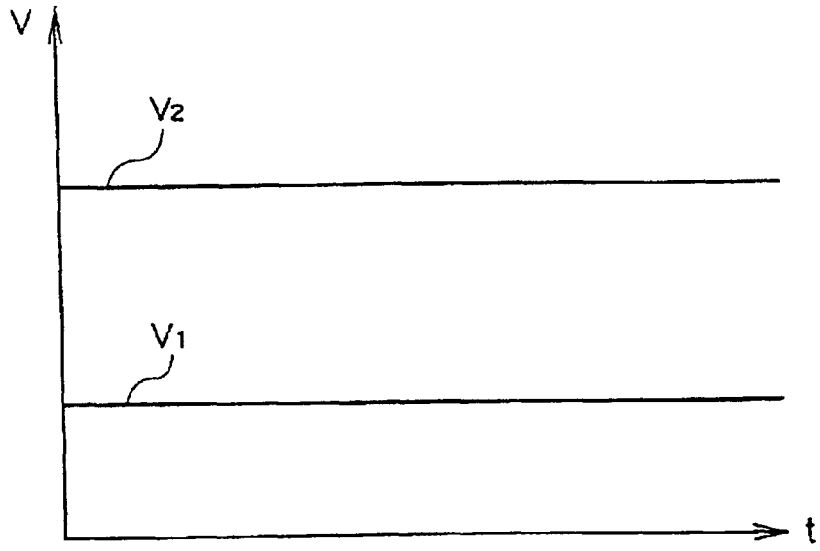
FIG. 8B is a time diagram showing an example of control input voltages V1 and V2 generated by a controller 184 shown in FIG. 7C, being different from one shown in FIG. 8A.

The control input voltages V1 and V2 can be generated as shown in FIG. 8B by the controller 184. FIG. 8B is a time diagram showing examples of control input voltages V1 and V2 that the controller 184 shown in FIG. 7C generates, being different from one shown in FIG. 8A.

As shown in FIG. 8B, in the case of this example, the control input voltages V1 and V2 are generated for a ratio therebetween to be constant. By implementing like this, the currents of the control current sources 182 and 183 shown in FIG. 7C can be controlled for the ratio therebetween to be constant. Thereby, thickness nonuniformity of the plating layer formed, only due to the cathode contact 64, on the wafer W surface being treated can be improved by the plating layer formed, due to the center cathode contact 91, with a constant ratio on the wafer W surface being treated. Accordingly, uniformity in plane of the current sending in the surface being treated of the wafer W can be improved, resultantly uniformity in plane of the liquid treatment (now, plating) being improved.

The ratio between magnitudes of the control input voltages V1 and V2 may be appropriately controlled so that the nonuniformity of the plating layer formed on the wafer W surface being treated can be more improved. Furthermore, ones shown in FIGS. 8A and 8B may be temporally combined.

Figure 9:
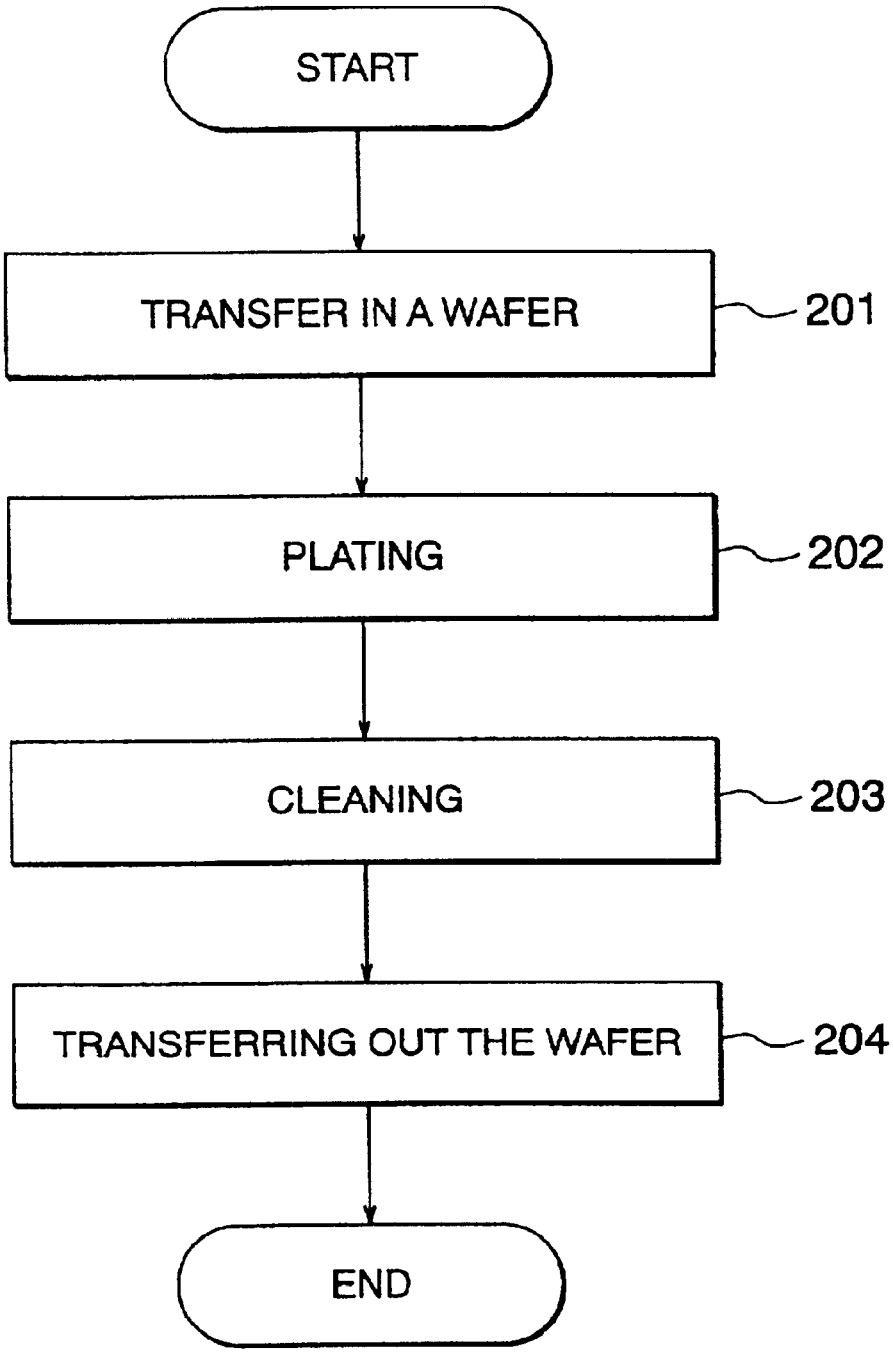
FIG. 9 is a flow chart showing a flow of an entire plating system shown in FIGS. 1 through 4.

Next, a treatment process of the entire plating system shown in FIGS. 1 through 4 will be explained. FIG. 9 is a flow chart showing a flow of the entire plating system shown in FIGS. 1 through 4.

As shown in FIG. 9, a power is turned on to start the plating system. On the susceptor 21, a transfer robot not shown in the drawing disposes the carrier cassette C that accommodates one lot, for instance, 25 sheets of untreated wafers W. Upon the disposition thereof, the sub-arm 22, after conceiving that the untreated wafers W are set, moves itself in front of the carrier cassette C. The sub-arm 22 inserts the wafer hold portion into the carrier cassette C to take out the accommodated untreated wafer W, disposing once the wafer W on the middle susceptor 36 in the process station (step 201). In the neighborhood of the susceptor 21, an alignment controller (not shown in the drawing) can be disposed to align a direction of the wafer W (alignment), thereafter the wafer W may be transferred on the sub-arm 22 or middle susceptor 36.

When the untreated wafer W is disposed on the middle susceptor 36, the main-arm 35, upon conceiving the disposition of the wafer W, start actuating and makes access to the middle susceptor 36 to receive the untreated wafer W. The main-arm 35 that has received the untreated wafer W makes access this time to the plating unit, for instance the plating unit M1, disposed on the lower tier side of the treatment space S to send the untreated wafer W in the plating unit M1.

The wafer W is plated in the plating unit M1 (step 202). The detailed procedure of the plating will be described later.

In the course of transferring the wafer W from the plating unit M1 to one of subsequent treatment units, for instance, the plating units M2 through M4, or the cleaning unit as the second treatment unit, as needs arise, the main-arm 35, while holding the wafer W, turns upside down the wafer W. For instance, it is such a case when, after a plating layer is formed on a lower surface side of the wafer W at the plating unit M1, the plated surface is directed upwardly to be cleansed in the cleaning unit. Thus, during the transfer of the wafer W, the wafer W can be turned upside down on the main-arm 35. Accordingly, there is no uselessness in the step of the treatment. Furthermore, the wafer W can be speedily and simultaneously transferred and turned upside down.

After a series of plating step is over, the main-arm 35 makes access into the last one of the plating units M1 through M4 to take out the plated wafer W.

Thereafter, the main-arm 35 moves, while holding the wafer W, the wafer hold portion to the upper portion of the treatment space S to send the wafer W in the cleaning unit 170 disposed on the upper tier side of the plating units M1 through M4, followed by the cleaning of the wafer W (step 203).

During the transfer, in the treatment space S, from above to below in the drawing, a down flow is formed in which the clean air flows down. As a result, the air does not flow from the plating units M1 through M4 on the lower tier side to the cleaning unit 170 on the upper tier side. Accordingly, an atmosphere in the neighborhood of the cleaning unit 170 in the treatment space S is always maintained cleaner than that in the neighborhood of the plating units M1 through M4.

After the cleaning due to the cleaning unit 170 is over, the wafer W is transferred out and a subsequent treatment, for instance annealing as a third treatment, may be implemented. The annealing can be implemented by disposing the wafer W on a so-called hot plate for a prescribed time period. When the annealing is over, once more the main-arm 35 receives the treated wafer W. The treated wafer W is, through the middle susceptor 36, or the cleaning unit 170, delivered from the main-arm 35 to the sub-arm 22.

The treated wafer W delivered to the sub-arm 22 goes through the opposite route to the above to be accommodated in the carrier cassette C (step 204). Thus, a series of treatment is over.

Figure 10:
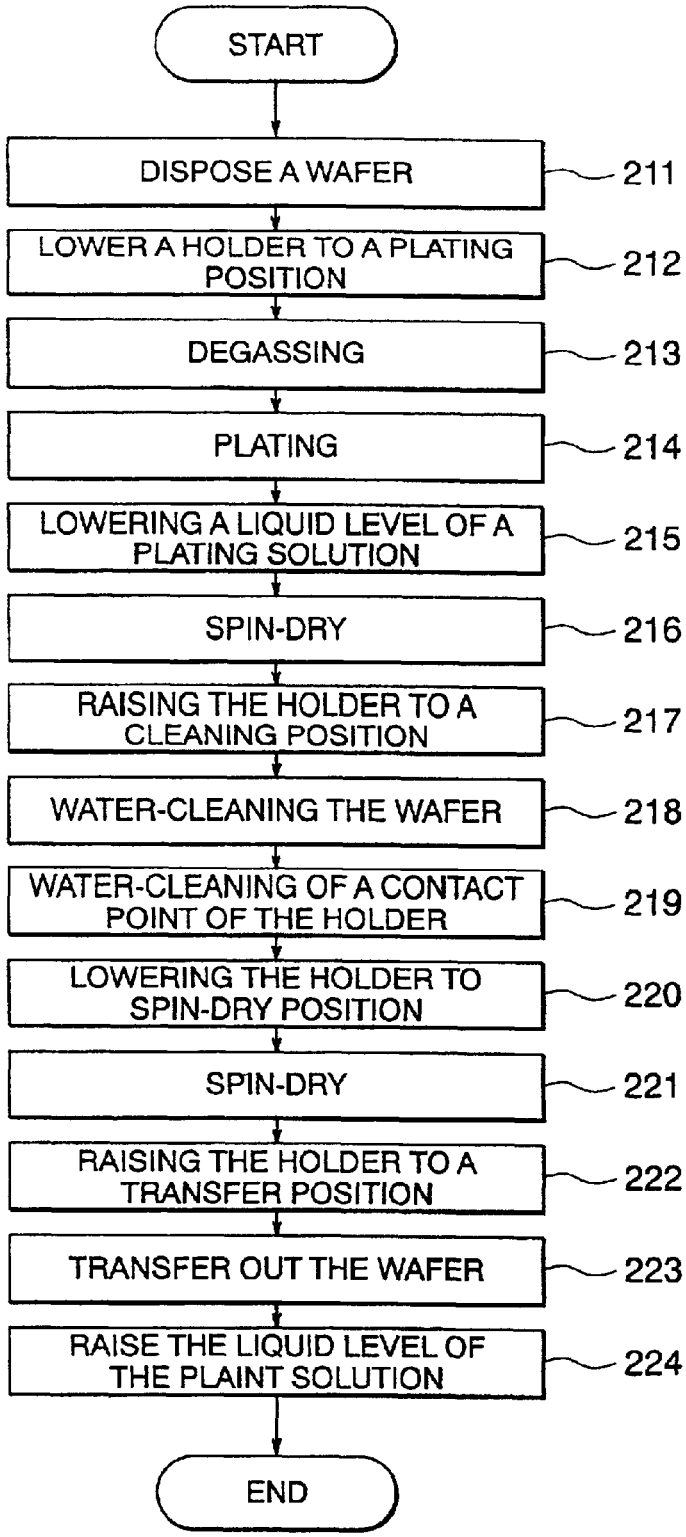
FIG. 10 is a flow chart illustrating a flow of plating treatment carried out in the plating unit M1 shown in FIGS. 1 through 4.

Next, the plating (step 202) of the flow of FIG. 9 showing a treatment process of the entire plating system shown in FIGS.1 through 4 will be detailed with reference to FIG. 10. FIG. 10 is a flow chart illustrating a flow of the plating carried out in the plating unit M1.

The main-arm 35, after receiving the untreated wafer W from the middle susceptor 36, makes access to the plating unit M1. That is, at the plating unit M1, after the gate valve 73 being opened, the main-arm 35, while holding the untreated wafer W, proceeds in the first treatment portion A to deliver the untreated wafer W to the holder 62 of the driver 61 waiting in the transfer position (I) (step 211).

After having set the untreated wafer W in the holder 62 of the driver 61, the gate valve 73 is shut, the cylinder 69 being actuated to lower the driver 61 to the plating position (V) (step 212). By the lowering operation, the surface being treated on the lower surface side of the wafer W held by the holder 62 comes into contact with the liquid level of the plating solution in the plating solution bath 42.

At that time, when implementing the plating of the wafer W with air bubbles on its surface, the plating layer formed on the surface of the wafer W is subject to be non-uniform. Accordingly, with the wafer W in contact with the liquid level of the plating solution, the motor 63 of the driver 61 is actuated to spin the wafer W in an approximately level plane, thereby degassing from the wafer W surface (step 213).

After sufficiently degassing, with the same height maintained, a rotation speed of the motor 63 is decreased, followed by an application of a voltage between the wafer W and the anode 44 in the plating solution bath 42 to start plating (step 214).

During the plating, by operating the switches 173 and 174 shown in FIGS. 7A and 7B, in various ways, a voltage can be applied. For instance, by alternatingly interrupting the switches 173 and 174, a direction of a current directing from the anode 44 to the lower wafer W surface side can be changed.

That is, upon at first turning on the switch 174 only to apply a cathode voltage to the cathode contact 64, a current from the anode 44 toward the wafer W periphery flows with intensity. Thereafter, upon turning off the switch 174 and turning on the switch 173 alone, the cathode current flows through the center cathode contact 91 to the neighborhood of the center of the wafer W. By thus alternatingly interrupting the switches 173 and 174, the current directing from the anode 44 to the wafer W repeats going to the wafer W periphery and to the center thereof W. Accordingly, as a whole, the current flows with uniform density over the entire lower wafer W surface side, resulting in a uniform plating layer.

Even when the control current sources 182 and 183 shown in FIG. 7C are used, as already explained above, due to the wafer W surface being treated, a more uniform plating layer can be formed.

When, after the passage of a prescribed time period, the plating layer of a sufficient thickness is formed on the wafer W, the application of the voltage is ceased to stop the formation of the plating layer. Upon opening a valve 52 and actuating a pump 51 for pumping out, the plating solution is exhausted into a tank 50 to lower the liquid level in the plating solution bath 42 (step 215), followed by raising the holder 62 to move the wafer W to the spin dry position (IV). In this state, the motor 63 is actuated to spin the wafer W in a level plane to spin dry (step 216).

When almost all of the plating solution is removed from the wafer W due to the spin dry, the driver 61 is raised up to the cleaning position (II) (step 217).

Next, in this state, while driving the motor 63 to spin the wafer W, purified water is ejected from a cleaning nozzle 70 toward a lower wafer W surface to cleanse the lower wafer W surface (step 218).

After the completion of the cleaning of the lower wafer W surface, with the height of the driver 61 maintained as it is, by means of a not shown elevator, the wafer W alone in the driver 61 is a little raised. The wafer W is raised up to a height where purified water ejected from the nozzle 70 comes into contact with the cathode contact 64. In this state, purified water is ejected from the nozzle 70 to cleanse the surface of the cathode contact (step 219).

After the cleaning of the cathode contact is over, the wafer W is once more lowered down to a height where the wafer W comes into contact with the cathode contact 64 (step 220), followed by actuating the motor 63 to spin dry, thereby removing moisture (step 221).

After the spin dry is over, the driver 61 is raised up to the transfer position (I) (step 222). While maintaining the wafer W in this position, the gate valve 73 is opened to make the main-arm 35 proceed, followed by transferring out the wafer W whose treatment in the plating unit M1 has completed (step 223). The liquid level of the plating solution in the plating solution bath 42 is raised in preparation for the subsequent treatment (step 224).

After the completion of the plating step at the plating unit M1, the wafer W is transferred to a treatment unit therein a succeeding treatment is implemented. When further implementing another plating in one of other plating units M2 through M4 plating solution of which is different in composition from that of the plating unit M1, the wafer W is transferred in the corresponding one of the plating units M2 through M4. Thereafter, similarly with the above, an additional subsequent plating can be implemented.

As mentioned above, the plating unit involving the present embodiment is provided with, besides the cathode contact 64, the center cathode contact mechanism 90 to apply the cathode voltage to the center of the wafer W. Accordingly, by the combined use together with the cathode contact 64, a direction of the current flowing from the anode 44 toward the wafer W can be controlled. By controlling the flow of the current, as a whole, the current can be uniformly flowed from the anode 44 to over an entire lower wafer W surface. Accordingly, a flow of copper ions also can be spread all over the entire lower wafer W surface. As a result, over the entire lower wafer W surface, a plating layer of uniform thickness can be formed.

The present invention is not restricted to the aforementioned embodiment. For instance, in the above embodiment, a silicon wafer is taken up for illustration to explain. However, needless to say, the present invention can be applied to a glass substrate for LCD. Furthermore, the center cathode contact mechanism 90 is disposed at the center of the wafer W. However, since a plurality of through holes W can be bored in on the surface of the wafer W, the similar cathode contact mechanisms can be disposed in the same number with the through holes. According to this, the current over the entire lower wafer W surface as a whole can be made more uniform.

(Second Embodiment)

Figure 11:
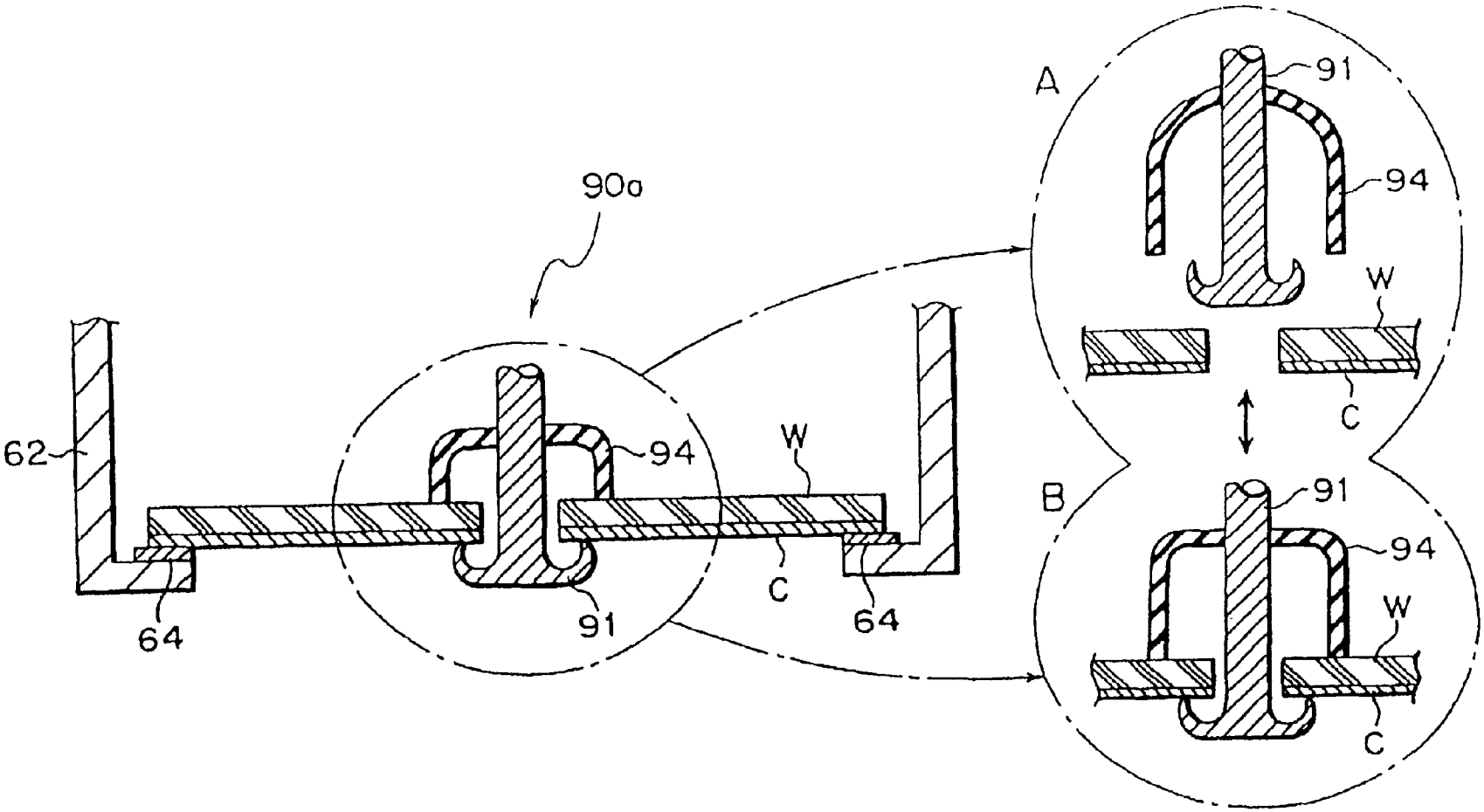
FIG. 11 is a vertical sectional view of a center cathode contact mechanism 90*a* involving a second embodiment of the present invention.

FIG. 11 is a vertical sectional view of a center cathode contact mechanism 90*a* involving a second embodiment of the present invention. In the explanation of the following embodiment, the contents overlapping with the preceding embodiment may be omitted from explanation.

As shown in FIG. 11, in the center cathode contact mechanism 90*a* involving the present embodiment, the center cathode contact 91 is constituted to come into direct contact with the seed layer C on the lower surface side of the wafer W.

That is, in the center cathode contact mechanism 90*a*, the center cathode contact 91 that is made of flexible conductive material and shaped in "IT" character in its section is held upside down, in the middle thereof a bowl like sealant 94 being pierced through.

When the center cathode contact 90*a* is employed, a wafer W whose surface being a treated side a seed layer C is formed on is prepared. The wafer is bored a through hole h in the center thereof to use.

As shown in a small circle A in FIG. 11, from the rear surface side of the wafer W, a head of the center cathode contact 91 is pushed against the through hole h. Since the center cathode contact 91 is made of the flexible conductive material, when going through the through hole h, the head is bent to reduce a dimension in a radius direction.

When pushing in furthermore, as shown in a small circle B, the head, after going through the through hole h, expands once more for an edge thereof to come into contact with the seed layer C on the lower wafer W surface side of the wafer W. On the other hand, on the rear surface side of the wafer W, the bowl like sealant 94 bends to push a lower edge thereof against the surface of the rear surface side of the wafer W, thereby sealing at a contact portion with the wafer W.

In the center cathode contact 90*a* involving the present embodiment, the center cathode contact 91 comes into contact with the wafer W on the surface being a treated side of the wafer W. It needs only for the through hole h to be bored in the center of the wafer W. Accordingly, an effect can be obtained that there is no need of forming the seed layer C on the rear surface side.

(Third Embodiment)

Figure 12:
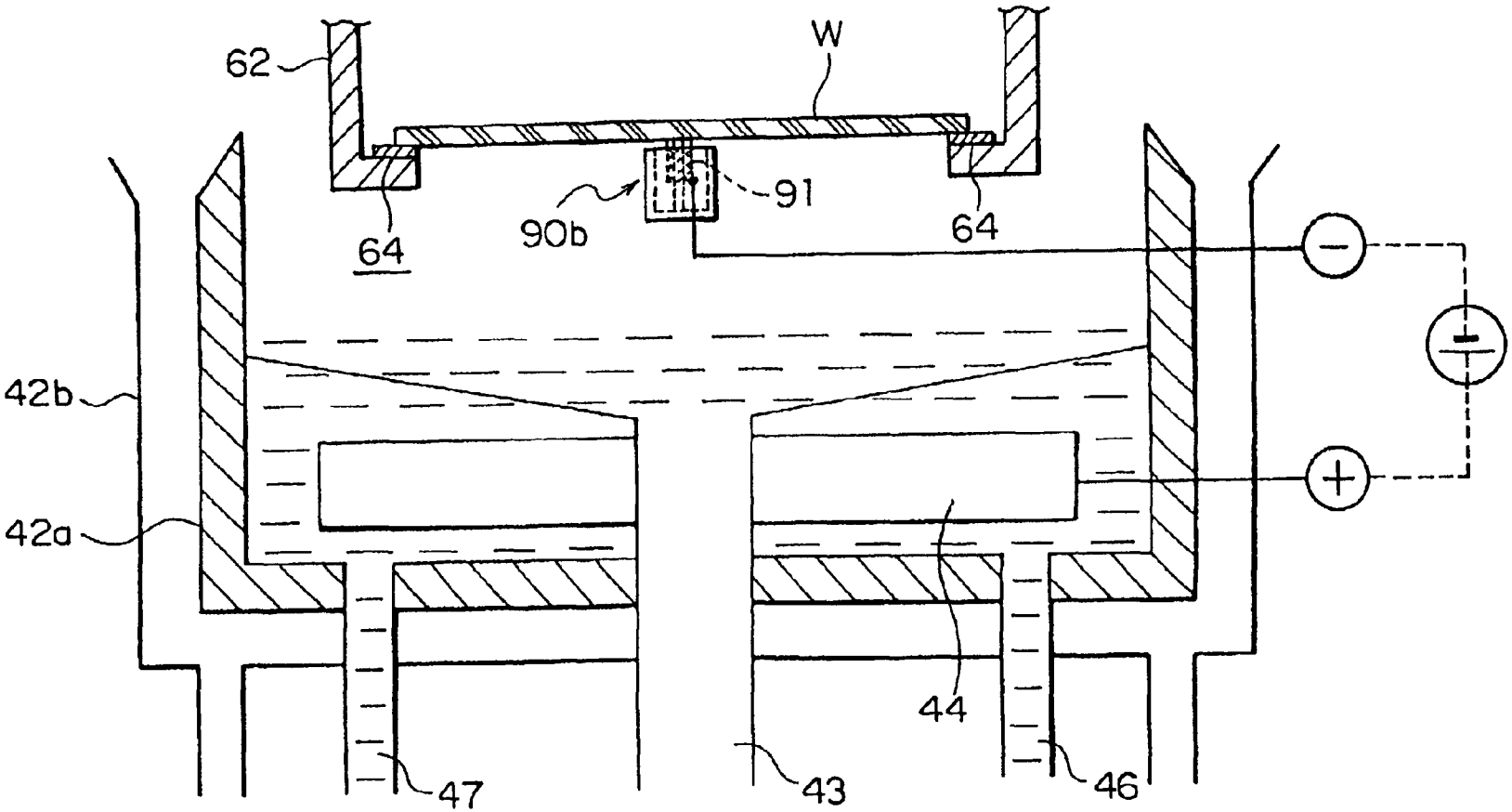
FIG. 12 is a diagram showing a wafer W holder at a lower end of the holder 62 shown in FIG. 5 and an electric system for applying a cathode voltage, being involved in a third embodiment of the present invention.

FIG. 12 shows a wafer W hold portion at the lower end of the holder 62 shown in FIG. 5 and an electric system for applying a cathode voltage, being involved with present third embodiment. In the plating unit involving the present embodiment, in the center of the surface being treated of the wafer W, a structure is adopted where a center cathode contact mechanism 90*b* is brought into contact with the wafer W from the surface being a treated side of the wafer W.

Figure 13:
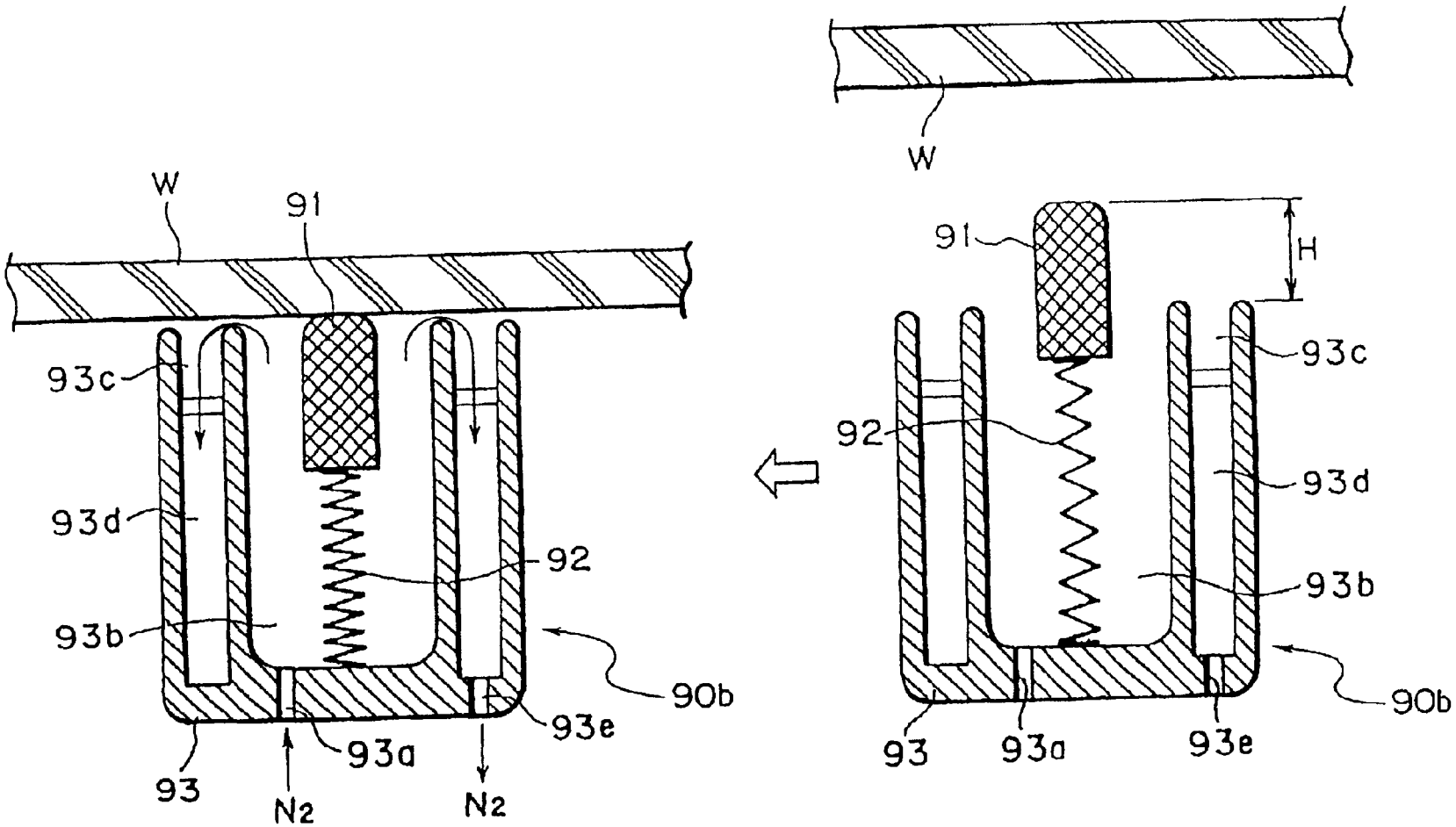
FIG. 13 is a diagram showing a vertical sectional view of a center cathode contact mechanism 90*b* in FIG. 12.
Figure 14:
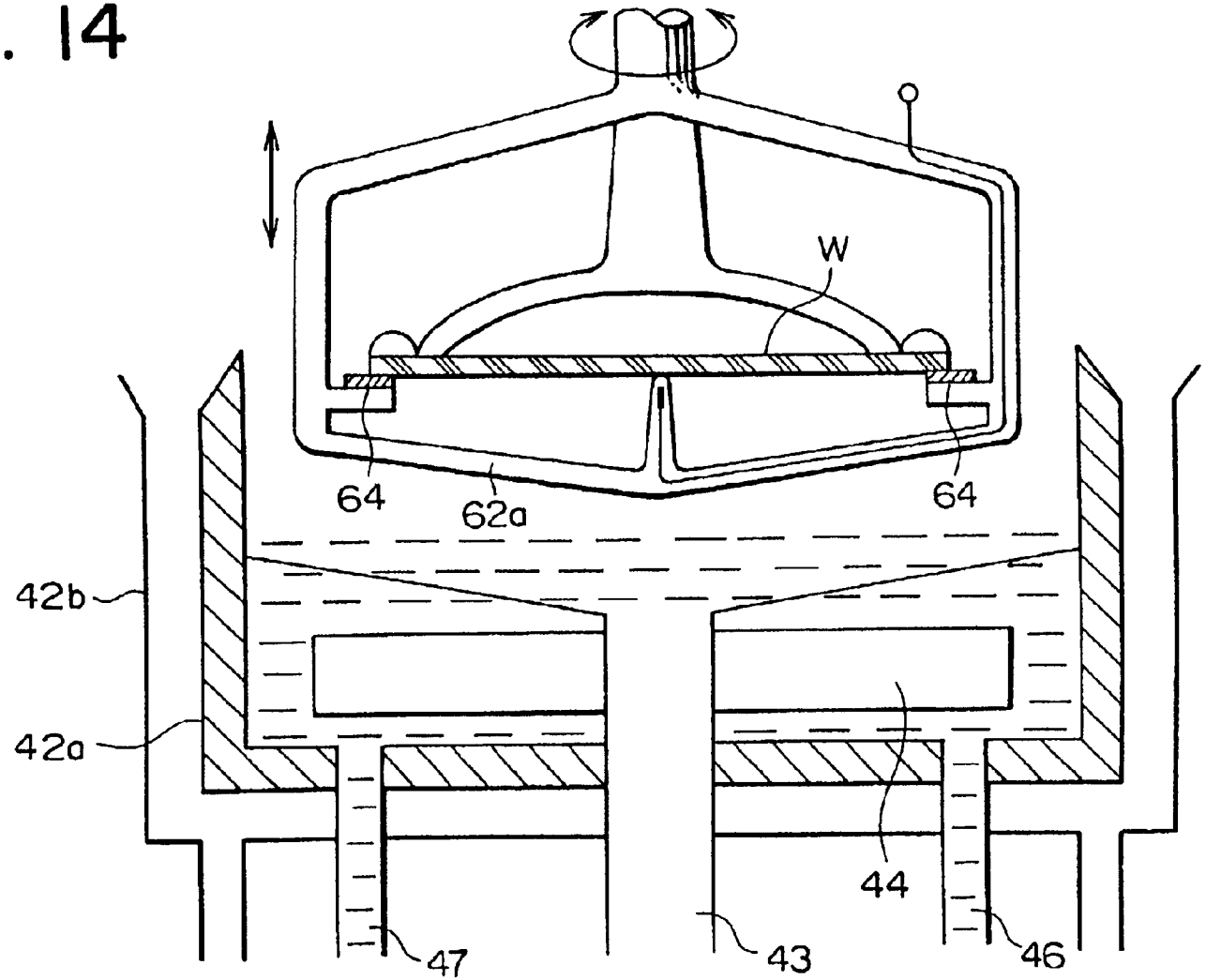
FIG. 14 is a diagram showing a vertical sectional view of a holder of the embodiment shown in FIG. 12.
Figure 15:
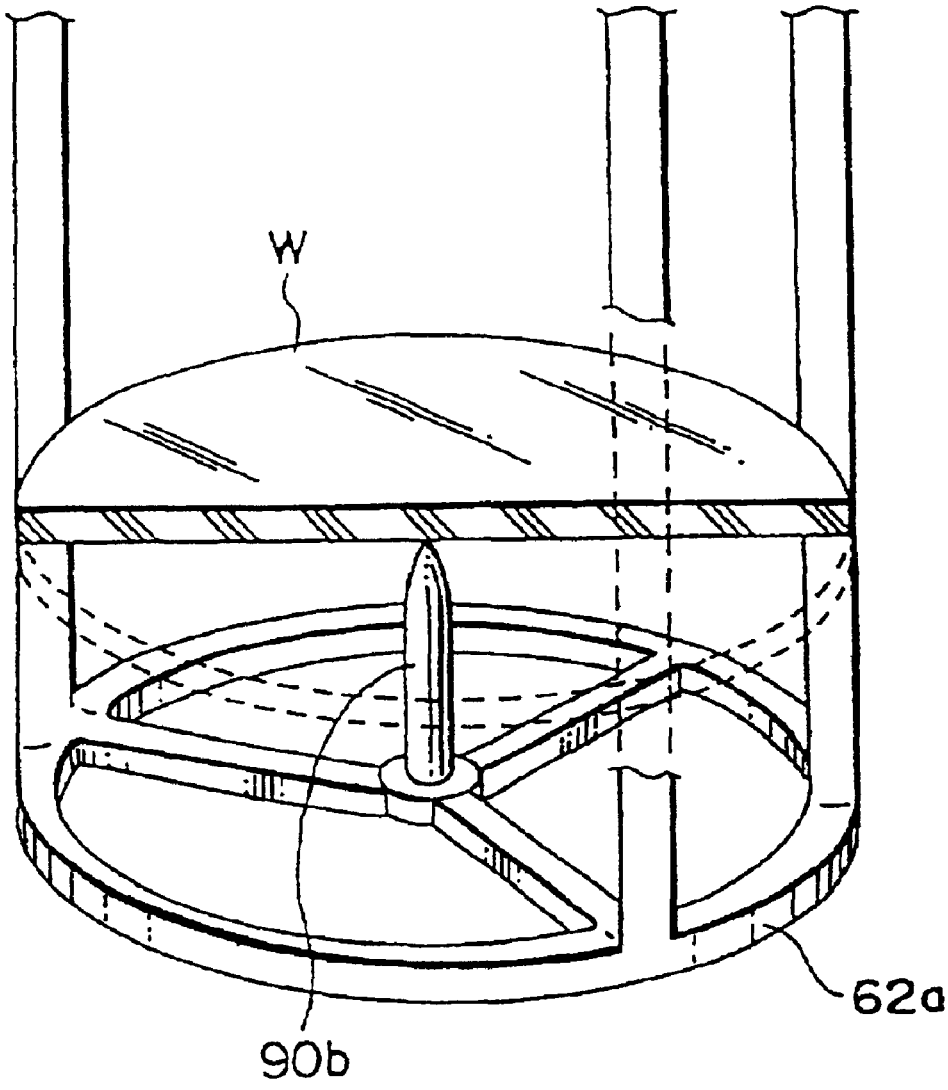
FIG. 15 is a perspective view of the holder 62 of the embodiment shown in FIG. 12.

FIG. 13 is a diagram showing a vertical sectional view of the center cathode contact mechanism 90*b* in FIG. 12, FIG. 14 a diagram showing a vertical sectional view of the holder 62 of the present embodiment shown in FIG. 12, FIG. 15 a perspective view of the holder 62 of the present embodiment shown in FIG. 12.

As mentioned above, in the plating unit involving the present embodiment, a structure is adopted where the center cathode contact mechanism 90*b* is brought into contact with the wafer W from the lower surface side (surface being a treated side) thereof W.

As shown in FIG. 13, in the center cathode contact mechanism 90*b* involving the present embodiment, the center cathode contact 91 made of conductive material such as metal is emergeably accommodated in a housing through elastic material for backing up such as a spring 92. The housing is a cup made of relatively soft insulating resin such as silicone rubber and functions concurrently as a sealant. To the center cathode contact 91, a lead wire (not shown in the drawing) is connected to connect with a power source.

A sidewall portion of the housing is structured hollow. Nitrogen gas fed from outside through a gas feed path 93*a* into a space 93*b* in the housing flows through a seal portion 93*c* disposed at an end of an opening side of the housing sidewall into a space 93*d* inside the sidewall. Finally, the introduced nitrogen gas is exhausted through a gas exhaust path 93*e* outside the center cathode contact mechanism 90*b*. Due to a gas such as the nitrogen or the like, the space 93*b* in the housing is maintained in a positive pressure, thereby preventing the plating solution or the like from intruding inside.

As an example where the center cathode contact mechanism 90*b* of the present embodiment is employed, a method where the holder 62 such as shown in FIG. 14 is used can be cited. FIG. 15 is a perspective view of a state shown in FIG. 14.

As shown in FIG. 15, the center cathode contact mechanism 90*b* of the present embodiment comes, upwardly from the lower surface side of the wafer W, into contact with the lower surface side of the wafer W. The center cathode contact mechanism 90*b* is fixed to the holder 62 by means of a circular and star like frame 62*a*.

In the present embodiment, the center cathode contact mechanism 90*b* that comes into contact with the center of the wafer W from the lower surface side thereof W is adopted. Accordingly, there is no need of boring the through hole h in the wafer W, resulting in efficiently securing semiconductor elements to be manufactured in the wafer W.

Furthermore, in the present embodiment, the circular and star like frame 62*a* supporting the center cathode contact mechanism 90*b* revolves together with the holder 62. The frame 62*a* functions as an agitation blade of the plating solution. As a result, the plating solution can be made uniform with ease, resulting in contributing in equalization of the plating layer to be formed. Also in the present embodiment, the center cathode contact mechanism may be disposed, without restricting onto the center of the wafer W, in a plurality to make a plurality of contacts. This will be explained in a fourth embodiment.

(Fourth Embodiment)

Figure 16:
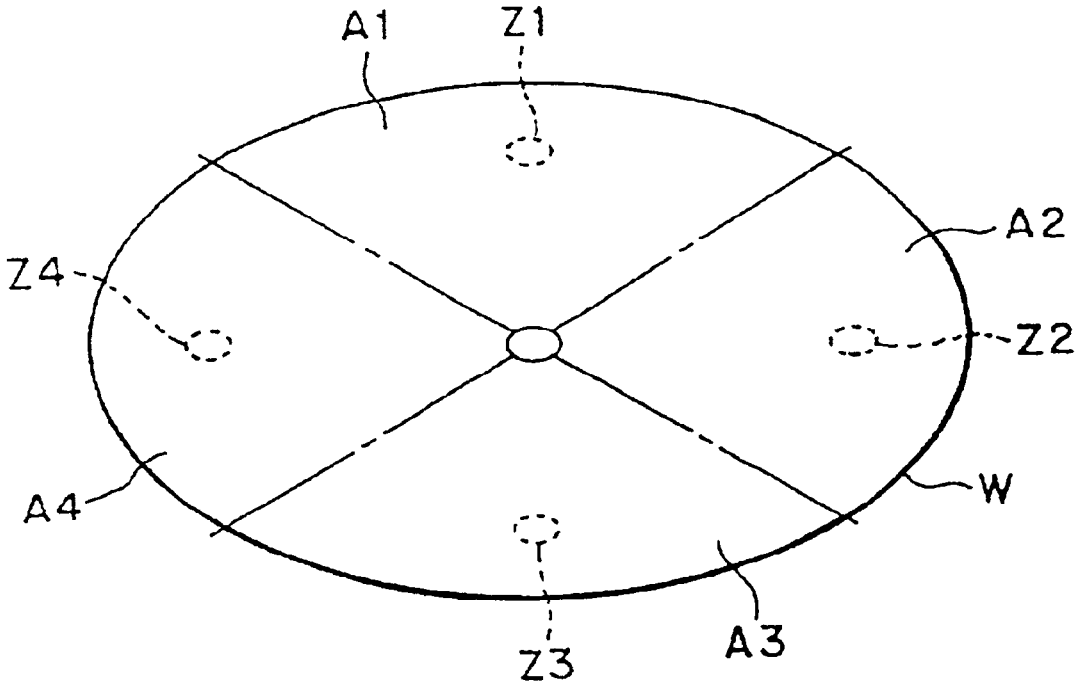
FIG. 16 is rough block diagram showing a point of contact between a cathode contact and a wafer in a plating unit involving a fourth embodiment of the present invention.

FIG. 16 is a rough block diagram illustrating a point of contact between the cathode contact and the wafer W in the plating unit involving the fourth embodiment of the present invention. That is, in the present embodiment, a surface being treated of the wafer W is divided into a plurality of zones, for instance four zones of zones A1 through A4. For the zones A1 through A4 each, one of zone cathode contacts Z1 through Z4 is disposed to bring into contact with the wafer W from the lower surface side.

With such contacts, while delaying a timing to apply a cathode voltage between the cathode contacts 64, 64, . . . and the zone cathode contacts Z1 through Z4, the plating is implemented. For instance, a sequential switching method where the cathode contact 64 and one of the zone cathode contact Z1 through Z4 are alternatingly switched like 64→A1→64→A2→64→A3→64→A4→64→A1→ . . . can be cited.

According to the present embodiment, the wafer W surface is divided into a certain number of zones, between the zones each and the periphery an applied voltage being alternatingly switched to implement the plating. Accordingly, as a whole, a current density is equalized to result in a plating layer of a thickness uniform all over the wafer W.

(Fifth Embodiment)

Figure 17:
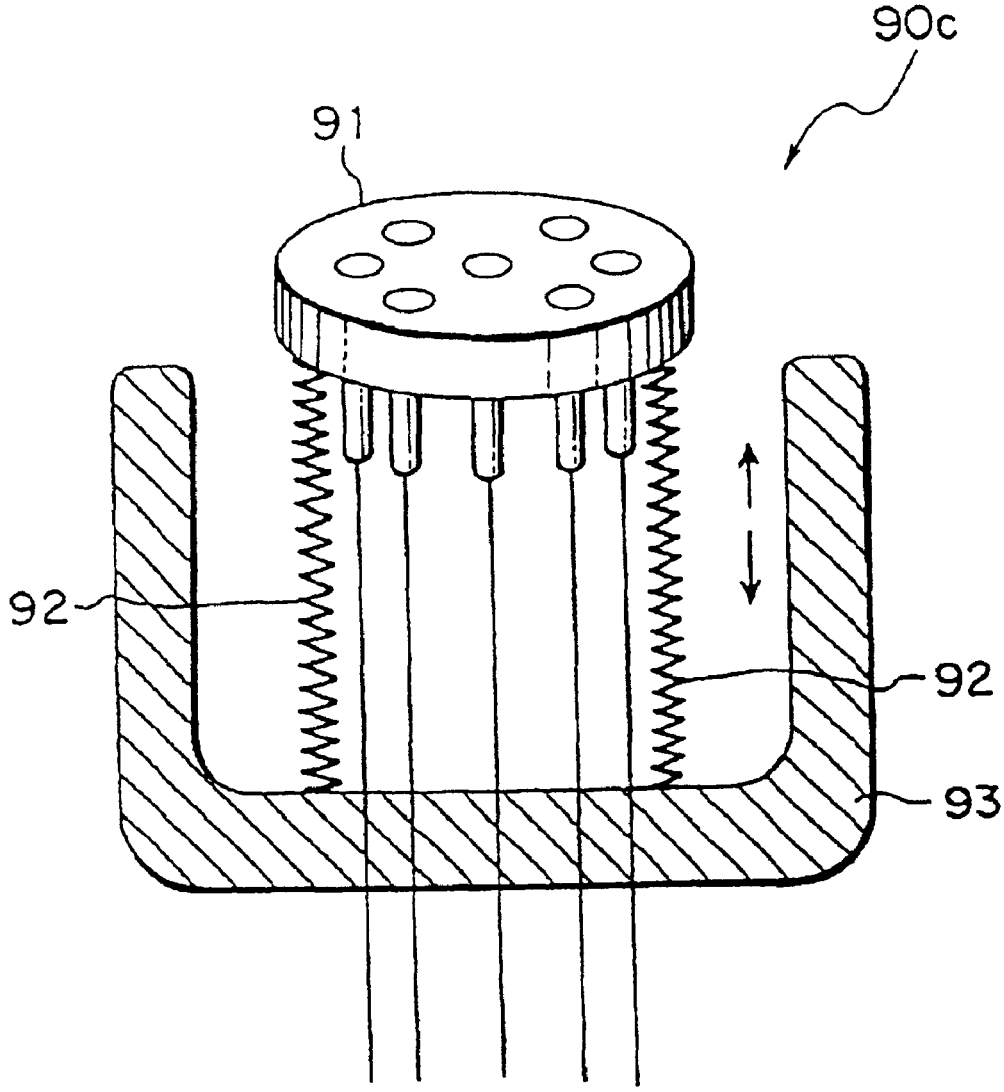
FIG. 17 is a block diagram showing, by a partial vertical sectional view, a center cathode contact mechanism 90*c* involving a fifth embodiment of the present invention.

FIG. 17 is a diagram showing a partial vertical sectional view of a center cathode contact mechanism 90*c* involving the fifth embodiment of the present invention. In the present embodiment, the center cathode contact 91 is structured into a bundle of a plurality of minute contacts.

That is, in the center cathode contact mechanism 90*c* involving the present embodiment, a plurality of minute contacts are bundled by flexible material such as rubber, the bundled body of the minute contacts being used as one center cathode contact 91.

In such center cathode contact mechanism 90*c*, a contact area between the wafer W becomes larger, resulting in an advantage of more assured application of the cathode voltage.

In the above first, second, third, fourth and fifth embodiments, the plating unit is taken up as an example of the liquid treatment unit to explain, also of the electrolytic polishing unit, however, only small modification on these embodiments enables to use with an approximately similar configuration.

(Sixth Embodiment)

Figure 18A:
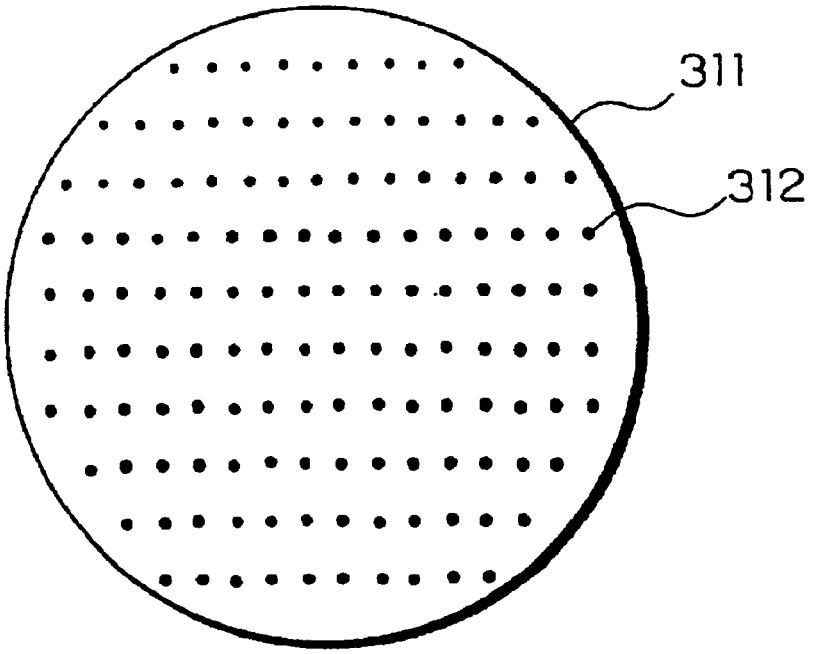
FIGS. 18A and 18B each are a plan view and a front view showing schematically a configuration of a plurality of needle bodies used in a liquid treatment unit that is a sixth embodiment of the present invention.
Figure 18B:
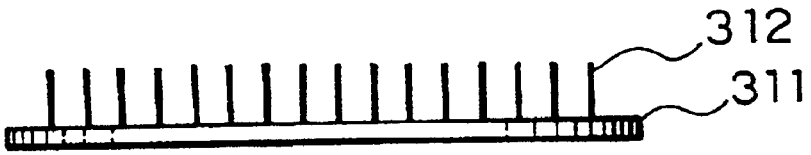

FIGS. 8A and 18B are plan and front views, respectively, showing schematically a plurality of needle bodies employed in the liquid treatment unit that is a sixth embodiment of the present invention. In the embodiment explained below, as the liquid treatment unit, an electrolytic polishing unit is primarily assumed in the explanation.

As shown in FIGS. 18A and 18B, a plurality of needle bodies 312 are disposed on base material 311. The needle bodies 312 are erected approximately vertically to the plate like base material 311, heights thereof being approximately the same. Furthermore, the density thereof is set to one that when implementing electrolytic polishing by the use of the needle bodies, sufficiently small voltage difference in the substrate surface being treated is generated.

Since an end of the needle body at a side opposite to the base material is brought into contact with the plating layer of a substrate to be manufactured (substrate being treated), the needle bodies 312 are preferable to have stiffness of an extent of coming into assured contact with the plating layer and flexibility of an extent of not generating scar on the plating layer.

To the needle body 312, electricity is supplied through the base material 311. Accordingly, to the base material 311, a connection (omitted from showing) is disposed to supply electricity from outside, from the connection electricity being conducted to the needle bodies 312 each. The needle bodies 312 are configured to include a conductor.

Figure 19:
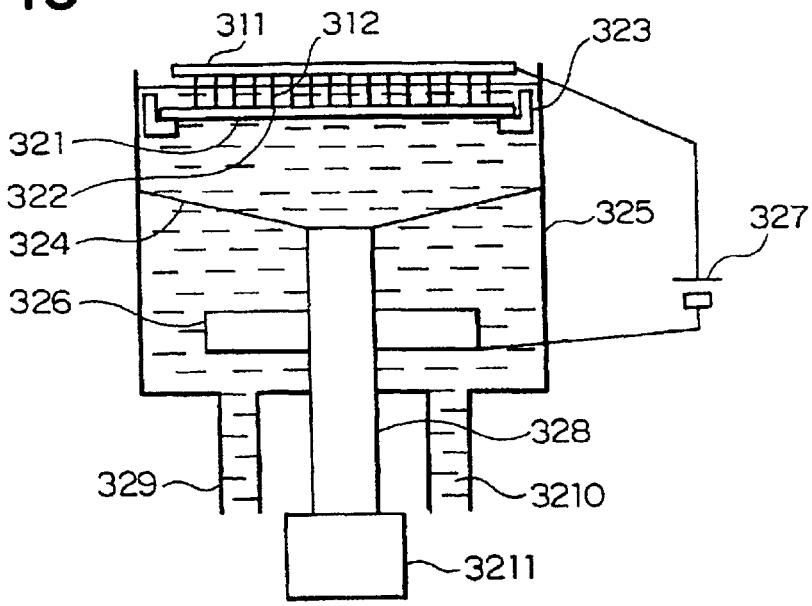
FIG. 19 is a diagram showing schematically a configuration of a unit where an electrolytic polishing process is carried out by the use of needle bodies 312 (one shown in FIGS. 18A and 18B).

Next, a configuration where with such needle bodies 312, an electrolytic polishing process is implemented will be explained with reference to FIG. 19. The same figure is a diagram showing schematically a configuration of a unit where with the needle bodies 312, the electrolytic polishing process is implemented.

As shown in the same figure, the configuration comprises a susceptor 323 for disposing a substrate being treated (wafer) 321, an electrolytic polishing solution bath 325, a cathode electrode 326, an electrolytic membrane 324, an ejection tube 328, a pump 3211, and a power source for electrolytic polishing 327. Here, to the electrolytic polishing solution bath 325, circulation piping 329 and 3210 is disposed to circulate the electrolytic polishing solution. In the present embodiment, in the substrate being treated 321, a surface being treated 322 is directed upwardly.

To the substrate being treated 321 whose surface being treated 322 is directed upwardly, the base material 311 is lowered from above so that the end portions of the needle bodies 312 are brought into contact. The connection (omitted from showing) that brings the base material 311 into electrical contact with the external is electrically connected to a positive side of the power source 327 for electrolytic polishing.

The cathode electrode 326 is immersed in an electrolytic polishing solution in the electrolytic polishing solution bath 325 to be fixed through the ejection tube 328, and receives power supply of negative side from the power source 327 for electrolytic polishing.

The ejection tube 328, which ejects the electrolytic polishing solution from a base side toward an upper surface, extends from an approximate center of a base of the electrolytic polishing solution bath 325 to an approximate middle in a depth direction of the electrolytic polishing solution bath 325. Thereunder, the pump 3211 is disposed to eject the electrolytic polishing solution.

Between an end periphery of the ejection tube 328 and the electrolytic polishing solution bath 325, the electrolytic membrane 324 is disposed.

At positions out of center on the base of the electrolytic polishing solution bath 325, the circulation piping 329 and 3210 is disposed to circulate the electrolytic polishing solution. Due to a pump not shown, one piping inhales the electrolytic polishing solution, the other piping supplying the electrolytic polishing solution to circulate the electrolytic polishing solution.

Operation when implementing the electrolytic polishing will be explained.

First, the wafer W being treated 321 is disposed on a prescribed position on the susceptor 323. After the substrate being treated 321 is disposed, the electrolytic polishing solution is ejected from the ejection tube 328 due to the pump 3211. Simultaneously, by means of the power source 327 for electrolytic polishing, electricity is supplied through the base material 311 and the needle bodies 312 between the surface being treated 322 and the cathode electrode 326. Thereby, metal on the surface being treated 322 is dissolved into the electrolytic polishing solution to polish a metal film.

According to such electrolytic polishing, power for the electrolytic polishing can be supplied, without due to the periphery of the surface being treated 322, by means of a plurality of needle bodies 312 on the surface being treated 322. Accordingly, the power supply for electrolytic polishing to the surface 322 being treated, even after the polishing reaches regionally to the lower surface of the metal layer, can be implemented in the other regions by means of the other needle bodies. Thereby, the metal to be removed does not remain irregularly on particular regions.

Figure 22:
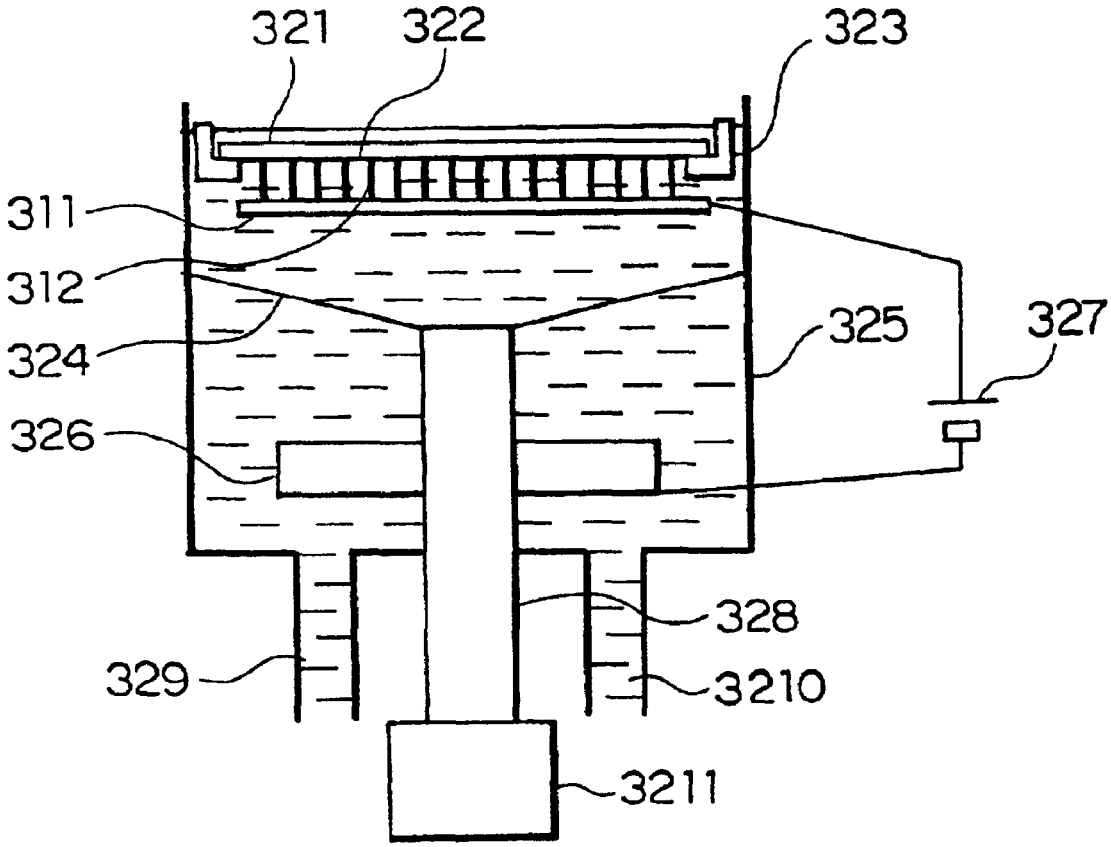
FIG. 22 is a diagram showing schematically a configuration of a unit different from one shown in FIG. 19 for implementing an electrolytic polishing process with a needle body 312 (one shown in FIGS. 18A and 18B).

The surface being treated 322 of the substrate being treated 321 may be treated with it directed downwardly. In this case, a configuration for implementing the process of electrolytic polishing with the needle bodies 312 is as shown in FIG. 22. The same figure is a diagram showing schematically a unit configuration different from the above one where the electrolytic polishing process is implemented with the needle bodies 312, the above mentioned constituent elements being given the same reference numerals.

That is, to the needle bodies 312 that is immersed in the electrolytic polishing solution, disposed on the base material 311 and directed upwardly, the surface being treated 322 of the substrate being treated 321 is brought into contact.

In this case also, without due to the periphery of the surface being treated 322, but due to a plurality of needle bodies 312, power is supplied onto the surface being treated 322 thereof to implement the electrolytic polishing. Accordingly, the power supply to the surface 322 being treated for electrolytic polishing, even after the polishing reaches regionally to the lower surface of the metal layer, can be implemented in the other regions by means of the other needle bodies. Thereby, the metal to be removed does not remain irregularly on particular regions.

(Seventh Embodiment)

Figure 20:
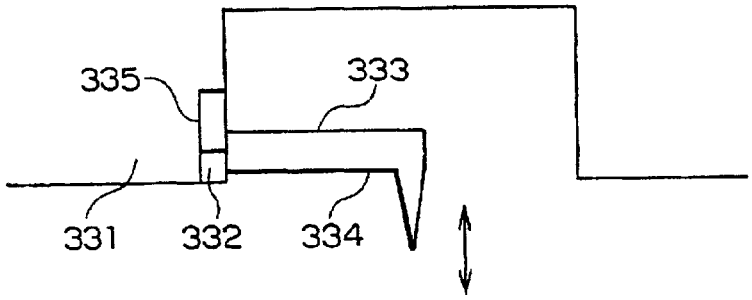
FIG. 20 is a schematic sectional view showing schematically one needle of a needle body applicable to a liquid treatment unit that is a seventh embodiment of the present invention.

Next, another method of electrical contact to the surface being treated 322 of the substrate being treated 321 that can be used in the present invention in the place of the aforementioned needle bodies 312 will be explained with reference to FIG. 20. The same figure is a sectional block diagram showing schematically one of needle bodies applicable to the liquid treatment unit that is a seventh embodiment of the present invention.

As shown in the same figure, in the needle body, at a portion close to a surface of a sidewall of a recess formed in a surface of a prescribed plate body 331 a cantilever 333 is disposed in parallel with the surface of the plate body 331. Furthermore, at the tip end of the cantilever 333, the needle body is disposed in a direction vertical to the surface of the plate body 331.

At the root of the cantilever 333, there are disposed piezoelectric elements 332 and 335, one 335 of these converting mechanical displacement at the root of the cantilever 333 due to bending thereof into electrical signal. The piezoelectric element 332, due to the application of a voltage, bends mechanically the root of the cantilever 333 to move the needle body at the tip end thereof in a direction vertical to the aforementioned surface.

To the cantilever 333 and the needle body thereof, metal 334 is given to mediate an electrical contact between the surface 322 being treated of the substrate 321.

The prescribed plate body 331 on which a number of such cantilevers 333 are formed is used in the place of the aforementioned base material 311 and needle bodies 312.

Such needle body and piezoelectric elements 332 and 335 disposed at the root thereof can be processed finely on the substrate (plate body 311) by means of microelectronics technology and micromachining technology.

Figure 21:
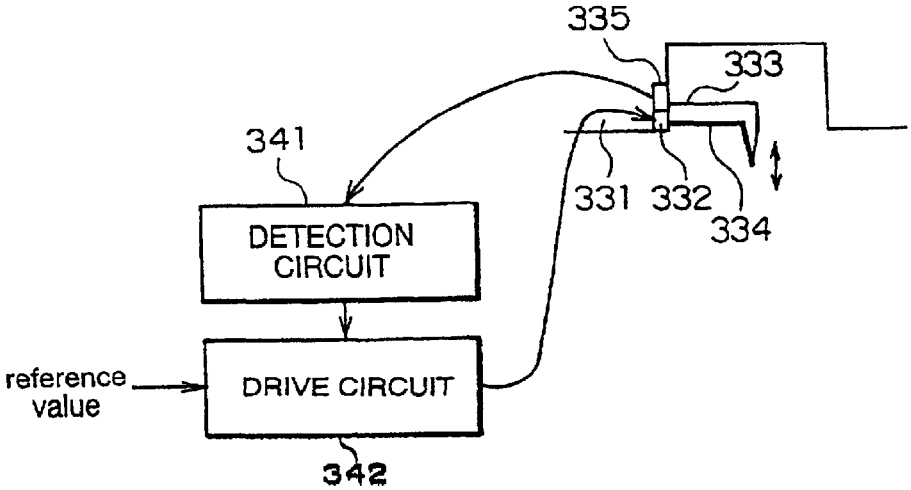
FIG. 21 is a diagram for explaining control of the needle body by means of piezoelectric elements 332 and 335 when with a plate body 331 therein a plurality of cantilevers 333 (one shown in FIG. 20) are formed, an electrolytic polishing process is implemented.

When implementing the process of electrolytic polishing by the use of the plate body 331 thereon a number of the aforementioned cantilevers 333 are formed, the needle body is controlled by means of the piezoelectric elements 332 and 335 as follows. The situation will be explained with reference to FIG. 21. The same figure is a block diagram for explaining the control of the needle body by means of the piezoelectric elements 332 and 335 when the process of electrolytic polishing is implemented by the use of the plate body 331 thereon a number of cantilevers 333 are formed. In the same figure, the constituent elements already explained are given the same reference numerals.

To the piezoelectric element 332, an output is fed from a drive circuit 342. To the drive circuit 342, a reference contact pressure is input and a detection output is fed from a detection circuit 341. To the detection circuit 341, a detection output is fed from the piezoelectric element 335. With such configuration, a contact pressure to the surface being treated of the substrate being treated due to the needle body of the cantilever 333 can be controlled.

That is, in advance, with respect to an output value of the drive circuit 342, a displacement of the cantilever 333 is measured to establish the relationship therebetween. When a planar body comes into contact with the needle body in a state where the drive circuit 342 supplies a certain output to the cantilever 333, the displacement different from the above relationship is generated in the cantilever 333. The displacement can be detected by means of the piezoelectric element 335. The difference from the natural position (position when nothing is in contact) of the cantilever 333 becomes a detected contact pressure. Accordingly, the output of the drive circuit 342 needs only be controlled for the difference to be a certain reference value.

When such needle body is used, a pressure when a plurality of needle bodies come into contact with the metal layer can be controlled at a definite value, thereby scratches on the substrate surface being treated due to the needle body being prevented from occurring. Accordingly, the electrolytic polishing of high quality can be realized. That is, in the course of the electrolytic polishing, following a state where the metal layer becomes thinner due to the electrolytic polishing, an optimum electrical contact is facilitated.

In the above sixth and seventh embodiments, the electrolytic polishing unit is taken as the liquid treatment unit for illustration to explain. However, these embodiments, with approximately identical configuration in which only slight modification is given to these embodiments, can be applied also to the plating unit.

As detailed above, according to the present invention, the contact is disposed to come into contact with the metal layer formed on the substrate being treated, the contact being able to come into contact with the surface being treated through the through hole present in the substrate being treated from the opposite surface. Accordingly, the electrical contact between the contact and the substrate being treated is not restricted to the neighborhood of the periphery. As a result, uniformity in plane of the current that is sent in the surface being treated can be improved, thereby uniformity in plane of the liquid treatment being improved.

Furthermore, according to the present invention, the contact is disposed to come into contact with the metal layer formed on the substrate being treated and can come into contact with an approximate center of the substrate being treated. Accordingly, the electrical contact between the contact and the substrate being treated is not restricted to the neighborhood of the periphery. As a result, uniformity in plane of the current that is sent in the surface being treated can be improved, thereby uniformity in plane of the liquid treatment being improved.

Furthermore, according to the present invention, a plurality of needle bodies come into electrical contact with the metal layer of the substrate being treated thereon the metal layer is formed. Accordingly, the power supply for electrolytic polishing to the surface being treated, even after the polishing reaches regionally to the lower surface of the metal layer, can be implemented in the other regions by means of the other needle bodies. Thereby, the metal to be removed does not remain irregularly on particular regions. Accordingly, uniformity in plane of the liquid treatment can be more improved.

What is claimed is:

1. A liquid treatment method in which by applying a voltage between an electrode disposed in contact with a treatment solution accommodated in a liquid treatment bath and a substrate being treated having a metal layer, the substrate being treated is liquid treated, the method comprising:

coming into electrical contact, due to a first contact member, with the metal layer of the substrate being treated at an approximate center of the substrate being treated;

supplying power of a negative side or positive side from the first contact member to the substrate being treated in electrical contact with the first contact member;

coming into electrical contact, due to a second contact member, with the metal layer of the substrate being treated at a periphery portion of the substrate being treated; and supplying power of a negative side or positive side from the second contact member to the substrate being treated in electrical contact with the second contact member;

wherein power supplies from the first contact member and the second contact member are controlled to increase and decrease alternatingly.

2. A liquid treatment method in which by applying a voltage between an electrode disposed in contact with a treatment solution accommodated in a liquid treatment bath and a substrate being treated having a metal layer, the substrate being treated is liquid treated, the method comprising:

coming into electrical contact, due to a first contact member, with the metal layer of the substrate being treated at an approximate center of the substrate being treated;

supplying power of a negative side or positive side from the first contact member to the substrate being treated in electrical contact with the first contact member;

coming into electrical contact, due to a second contact member, with the metal layer of the substrate being treated at a periphery portion of the substrate being treated; and supplying power of a negative side or positive side from the second contact member to the substrate being treated in electrical contact with the second contact member;

wherein power supplies from the first contact member and the second contact member are controlled to be implemented alternatingly.

* * * * *